US009059530B2

(12) United States Patent
Byrne et al.

(10) Patent No.: US 9,059,530 B2
(45) Date of Patent: Jun. 16, 2015

(54) ACCESS-RESTRICTED ELECTRICAL RECEPTACLE

(71) Applicants: Norman R. Byrne, Ada, MI (US); Robert L. Knapp, Rockford, MI (US); Randell E. Pate, Jenison, MI (US); Gerald N. Vander Till, Grandville, MI (US)

(72) Inventors: Norman R. Byrne, Ada, MI (US); Robert L. Knapp, Rockford, MI (US); Randell E. Pate, Jenison, MI (US); Gerald N. Vander Till, Grandville, MI (US)

( * ) Notice: Subject to any disclaimer, the term of this patent is extended or adjusted under 35 U.S.C. 154(b) by 0 days.

(21) Appl. No.: 14/445,468

(22) Filed: Jul. 29, 2014

(65) Prior Publication Data

US 2015/0037989 A1 Feb. 5, 2015

Related U.S. Application Data

(60) Provisional application No. 61/947,649, filed on Mar. 4, 2014, provisional application No. 61/859,920, filed on Jul. 30, 2013.

(51) Int. Cl.
*H01R 13/44* (2006.01)
*H01R 13/453* (2006.01)

(52) U.S. Cl.
CPC ..... *H01R 13/4534* (2013.01)

(58) Field of Classification Search
CPC ..... H01R 13/4534; H01R 13/7135; H01R 25/006; H01R 24/62
See application file for complete search history.

(56) References Cited

U.S. PATENT DOCUMENTS

| | | | |
|---|---|---|---|
| 2,477,803 | A | 8/1949 | Huber |
| 2,528,014 | A | 10/1950 | Moses, Jr. et al. |
| 2,610,999 | A | 9/1952 | Silver |
| 2,740,943 | A | 4/1956 | Young |
| 2,770,786 | A | 11/1956 | Czyzewski |
| 3,222,631 | A | 12/1965 | Cohen |
| 3,238,492 | A | 3/1966 | Houston |
| 3,601,758 | A | 8/1971 | Davidsson |

(Continued)

FOREIGN PATENT DOCUMENTS

| | | | |
|---|---|---|---|
| CN | 2449374 | Y | 9/2001 |
| CN | 2681385 | Y | 2/2005 |

(Continued)

OTHER PUBLICATIONS

International Search Report and Written Opinion for corresponding PCT Application No. PCT/US2014/048571 dated Nov. 10, 2014.

*Primary Examiner* — Jean F Duverne
(74) *Attorney, Agent, or Firm* — Gardner, Linn, Burkhart & Flory, LLP

(57) ABSTRACT

An access-restricted electrical receptacle is configured to permit proper access to energized electrical contacts within the receptacle by a corresponding and properly-aligned plug, and to substantially limit or prevent improper access by foreign objects. The receptacle includes a receptacle body that defines a shutter cavity and a ramped slide surface, a face portion coupled to the receptacle body and defining a plurality of outlet openings to the shutter cavity, and a shutter that is movable in the shutter cavity between an unblocking position and at least one blocking position. The face portion defines a ramped return surface spaced from the ramped slide surface, and the shutter includes contact surfaces that engage the slide surface and the return surface during operation. Optionally, the ramped surfaces may be formed in either or both of a side wall or a base wall of the receptacle body and the face portion.

20 Claims, 16 Drawing Sheets

(56) References Cited

U.S. PATENT DOCUMENTS

| | | | |
|---|---|---|---|
| 3,736,547 | A | 5/1973 | Koenig |
| 4,094,569 | A | 6/1978 | Dietz |
| 4,168,104 | A | 9/1979 | Buschow |
| 4,379,607 | A | 4/1983 | Bowden, Jr. |
| 4,493,517 | A | 1/1985 | Hillary |
| 4,544,219 | A | 10/1985 | Barkas |
| 4,584,430 | A | 4/1986 | Belknap |
| 4,722,693 | A | 2/1988 | Rose |
| 4,822,290 | A | 4/1989 | Cauley et al. |
| 4,867,694 | A | 9/1989 | Short |
| 5,006,075 | A | 4/1991 | Bowden, Jr. |
| 5,011,419 | A | 4/1991 | Maan |
| 5,020,997 | A | 6/1991 | Calderara et al. |
| 5,069,630 | A | 12/1991 | Tseng et al. |
| 5,267,870 | A | 12/1993 | Maresh |
| 5,281,156 | A | 1/1994 | Yi |
| 5,374,199 | A | 12/1994 | Chung |
| 5,518,132 | A | 5/1996 | Chen |
| 5,839,909 | A | 11/1998 | Calderara et al. |
| 5,915,981 | A | 6/1999 | Mehta |
| 6,056,564 | A | 5/2000 | Huang |
| 6,086,391 | A | 7/2000 | Chiu |
| 6,146,160 | A | 11/2000 | Chang |
| 6,149,446 | A | 11/2000 | Yu |
| 6,217,353 | B1 | 4/2001 | Yu-Tse |
| 6,224,401 | B1 | 5/2001 | Yu |
| 6,238,224 | B1 | 5/2001 | Shao |
| 6,332,781 | B1 | 12/2001 | Ito |
| 6,394,826 | B1 | 5/2002 | Baxter et al. |
| 6,422,880 | B1 | 7/2002 | Chiu |
| 6,537,088 | B2 | 3/2003 | Huang |
| 6,537,089 | B1 | 3/2003 | Montague |
| 6,555,771 | B2 | 4/2003 | Shao |
| 6,739,887 | B1 | 5/2004 | Yu |
| 6,753,755 | B2 | 6/2004 | Montague |
| 6,767,228 | B2 | 7/2004 | Katz |
| 6,776,630 | B1 | 8/2004 | Huang |
| 6,786,744 | B1 | 9/2004 | Lee |
| 6,786,745 | B1 | 9/2004 | Huang |
| 6,814,594 | B1 | 11/2004 | Huang |
| 6,893,275 | B2 | 5/2005 | Ng et al. |
| 6,932,631 | B2 | 8/2005 | Huang |
| 6,943,297 | B2 | 9/2005 | Capella |
| 6,969,801 | B2 | 11/2005 | Radosavljevic et al. |
| 7,114,968 | B2 | 10/2006 | Healy |
| 7,179,992 | B1 | 2/2007 | Packard et al. |
| 7,214,101 | B1 | 5/2007 | Tong |
| 7,312,394 | B1 | 12/2007 | Weeks et al. |
| 7,312,963 | B1 | 12/2007 | Radosavljevic et al. |
| 7,355,117 | B2 | 4/2008 | Castaldo et al. |
| 7,438,567 | B2 | 10/2008 | Nalwad et al. |
| 7,452,221 | B1 | 11/2008 | Oddsen et al. |
| 7,455,538 | B2 | 11/2008 | Germain |
| 7,510,412 | B1 | 3/2009 | Valentin |
| 7,537,468 | B1 | 5/2009 | Huang et al. |
| 7,551,047 | B2 | 6/2009 | Sokolow et al. |
| 7,554,033 | B1 | 6/2009 | Bhosale et al. |
| 7,556,513 | B2 | 7/2009 | Ng et al. |
| 7,588,447 | B1 | 9/2009 | Ni |
| 7,633,009 | B1 | 12/2009 | Baldwin |
| 7,637,756 | B1 | 12/2009 | Hsu |
| 7,642,457 | B2 | 1/2010 | Weeks et al. |
| 7,645,148 | B2 | 1/2010 | Carbone et al. |
| 7,645,149 | B2 | 1/2010 | Carbone et al. |
| 7,651,347 | B2 | 1/2010 | Germain et al. |
| 7,651,348 | B2 | 1/2010 | Huang et al. |
| 7,695,293 | B1 | 4/2010 | Sikes |
| 7,722,389 | B2 | 5/2010 | Benoit et al. |
| 7,753,700 | B2 | 7/2010 | Ma |
| 7,790,982 | B2 * | 9/2010 | Weeks et al. ..... 174/50 |
| 7,820,909 | B2 | 10/2010 | Castaldo et al. |
| 7,833,030 | B1 | 11/2010 | Huang |
| 7,868,719 | B2 | 1/2011 | Bazayev et al. |
| 7,869,171 | B2 | 1/2011 | Weeks et al. |
| 7,883,346 | B2 | 2/2011 | Huang |
| 7,887,346 | B1 | 2/2011 | Huang |
| 7,887,349 | B1 | 2/2011 | Macomber |
| 7,914,307 | B1 | 3/2011 | Yang |
| 7,934,935 | B1 | 5/2011 | Gao |
| 7,938,676 | B1 | 5/2011 | Patel et al. |
| 7,942,681 | B2 | 5/2011 | Ni |
| 7,985,085 | B2 | 7/2011 | Gao |
| 7,997,925 | B2 | 8/2011 | Lam et al. |
| 8,007,296 | B2 | 8/2011 | Chen et al. |
| 8,044,299 | B2 | 10/2011 | Weeks |
| 8,062,072 | B2 | 11/2011 | Ziobro |
| 8,063,303 | B1 | 11/2011 | McBain |
| 8,100,705 | B2 | 1/2012 | Chen et al. |
| 8,105,094 | B2 | 1/2012 | Patel et al. |
| 8,147,260 | B2 | 4/2012 | Huang |
| 8,187,011 | B1 | 5/2012 | Baldwin et al. |
| 8,187,012 | B1 | 5/2012 | Baldwin et al. |
| 8,193,445 | B2 | 6/2012 | Li |
| 8,242,362 | B2 | 8/2012 | Castaldo et al. |
| 8,297,990 | B2 | 10/2012 | Huang |
| 8,366,463 | B2 | 2/2013 | Zhang et al. |
| 8,382,497 | B2 | 2/2013 | Huang |
| 8,435,055 | B1 | 5/2013 | Bhosale |
| 8,462,006 | B2 | 6/2013 | Chen |
| 8,465,305 | B2 | 6/2013 | Wilkie et al. |
| 8,480,415 | B2 | 7/2013 | Byrne |
| 8,480,420 | B2 | 7/2013 | Ziobro |
| 8,491,319 | B1 | 7/2013 | Baldwin et al. |
| 8,523,599 | B2 | 9/2013 | Lazzaro |
| 8,550,829 | B2 | 10/2013 | Huang |
| 8,562,362 | B2 | 10/2013 | Jiang et al. |
| 8,568,152 | B1 | 10/2013 | Weeks |
| 8,616,904 | B1 | 12/2013 | Martin et al. |
| 8,632,347 | B2 | 1/2014 | Chen et al. |
| 8,632,348 | B2 | 1/2014 | Baldwin et al. |
| 8,672,695 | B2 | 3/2014 | Baldwin et al. |
| 2004/0203270 | A1 | 10/2004 | Wang |
| 2009/0286411 | A1 | 11/2009 | Bazayev et al. |
| 2010/0159722 | A1 | 6/2010 | Chen |
| 2010/0317208 | A1 * | 12/2010 | Chen et al. ..... 439/140 |
| 2011/0092085 | A1 * | 4/2011 | Gao ..... 439/137 |
| 2011/0263145 | A1 | 10/2011 | Kim |
| 2012/0170292 | A1 | 7/2012 | Bhosale et al. |
| 2012/0287572 | A1 | 11/2012 | Huang |
| 2013/0141822 | A1 | 6/2013 | Weeks et al. |

FOREIGN PATENT DOCUMENTS

| | | |
|---|---|---|
| GB | 2068651 | 8/1981 |
| JP | 2006040733 A | 2/2006 |
| KR | 10-2011-0134778 | 12/2011 |
| RU | 2125329 C1 | 1/1999 |

* cited by examiner

ACCESS-RESTRICTED ELECTRICAL RECEPTACLE

CROSS REFERENCE TO RELATED APPLICATIONS

The present application claims the priority benefit of U.S. provisional application Ser. No. 61/947,649, filed Mar. 4, 2014, and of U.S. provisional application Ser. No. 61/859,920, filed Jul. 30, 2013, which are hereby incorporated herein by reference in their entireties.

FIELD OF THE INVENTION

The present invention relates to electrical receptacles and, more particularly, to electrical receptacles that, typically for safety reasons, block or limit improper access to electrical contacts that are contained within the receptacles.

BACKGROUND OF THE INVENTION

Electrical receptacles or outlets, such as 110V AC or 220V AC simplex or duplex outlets or the like, are typically designed to receive at least two or three conductive prongs of an electrical plug associated with an electrical consumer, such as an appliance. The electrical receptacles have openings that receive respective prongs of an electrical plug, and have female electrical contacts spaced behind the openings, but the receptacle openings are typically too small (and the electrical contacts spaced too far rearwardly) for children's fingers or other common household objects to be inserted. However, paperclips, small screwdrivers, nails, and many other common objects are both electrically conductive and sufficiently small to easily pass through the openings and come into conductive contact with the electrical contacts of a typical electrical receptacle, which presents a risk of electrical shock, particularly for children or persons unfamiliar with (or unable to fully comprehend) the risks associated with electrical outlets and contact with electrical current.

SUMMARY OF THE INVENTION

The present invention provides an access-restricted or tamper-resistant electrical outlet that limits or precludes access to at least its hot or "line" contact and its neutral contact, by individual small objects that could otherwise be inserted into the receptacle openings that are designed to receive respective prongs of an electrical plug. A movable shutter or slider is positioned in an interior space of the receptacle, behind a face or cover plate that defines openings for receiving the prongs of a plug, and when no plug is engaging the receptacle, the shutter or slider is in a blocking position that substantially blocks a path between the openings and the hot and neutral electrical contacts within the receptacle. When a small object is inserted through one of the openings associated with the hot or neutral electrical contact, the object contacts the shutter, which remains in the same or similar blocking position and continues to substantially block access to the hot and neutral electrical contacts. However, when the prongs of an electrical plug are simultaneously urged through the respective receptacle openings so that the shutter is contacted with substantially even pressure applied by prongs, the shutter will move in a manner that permits the prongs to move past the shutter and into contact with the respective electrical contacts within the receptacle. Various contact surfaces on the shutter and the interior of the receptacle guide or limit movement of the shutter in response to the application of pressure by either a proper plug, or by an improper small object.

According to one form of the present invention, an access-restricted electrical receptacle includes a receptacle body, a face portion mounted to the receptacle body, a shutter movably disposed in a shutter cavity defined between the face portion and the receptacle body, and a biasing member for biasing the shutter in a direction toward the face portion. The body defines a ramped slide surface and the face portion defines a ramped return surface, the ramped surfaces for guiding the movement of the shutter in the shutter cavity. The receptacle body contains a plurality of electrical contacts disposed in said receptacle body and accessible via said shutter cavity, the electrical contacts configured to receive respective prongs of an electrical plug associated with an electrical consumer. The face portion defines a plurality of receptacle openings that are generally aligned with corresponding ones of the electrical contacts, and the face portion defines a ramped return surface spaced from the ramped slide surface. The shutter has a first contact surface for engaging the ramped slide surface, and has a second contact surface for engaging the ramped return surface. The shutter is movable between at least one blocking position in which the shutter substantially precludes access to the electrical contacts, and a non-blocking position in which the shutter permits access to the electrical contacts. The receptacle body and/or the face portion define first and second locking surfaces, which define respective portions of the shutter cavity. The shutter is configured to move from the blocking position to the non-blocking position via sliding engagement of the first contact surface along the ramped slide surface, to move from the non-blocking position to the blocking position via sliding engagement of the second contact surface along the ramped return surface, and to be positioned in the at least one blocking position in response to an object being inserted into only one of the receptacle openings and causing a portion of the shutter to engage at least one of the first and second locking surfaces.

In one aspect, the receptacle body defines at least two of the ramped slide surfaces at the shutter cavity, and the face portion defines at least two of the ramped return surfaces spaced from the ramped slide surfaces.

Optionally, the receptacle body includes a plurality of sidewalls substantially surrounding the shutter cavity, and the sidewalls define the ramped slide surfaces.

In another aspect, the ramped return surfaces project rearwardly from a rear surface the face portion, thereby defining sloped slots between corresponding ones of the ramped return surfaces and the ramped slide surfaces. The shutter includes wing projections extending laterally outwardly from opposite sides of the shutter, and into respective ones of the sloped slots. Each of the wing projections defines one of the first contact surfaces and one of the second contact surfaces.

In yet another aspect, the receptacle body includes a ramped base surface at the shutter cavity, and the shutter includes an end contact surface at one end thereof. The end contact surface is configured to engage the ramped base surface upon movement of the shutter to the non-blocking position, and also in at least one of the blocking positions.

In still another aspect, the first locking surface includes a detent region formed in one of the sloped slots, and the second locking surface includes a projection of the face portion that extends into the shutter cavity.

According to another aspect of the present invention, an access-restricted electrical receptacle includes a receptacle body, a plurality of electrical contacts, at least one ramped slide surface, a front face portion, at least one ramped return surface, a shutter, locking surfaces, and a biasing member. The receptacle body defines a shutter cavity and receives a plurality of electrical contacts that are accessible via the shutter cavity. The electrical contacts configured to receive respective prongs of an electrical plug that is associated with an electrical consumer. The at least one ramped slide surface is located at or adjacent the shutter cavity, while the at least one ramped return surface is also located at or adjacent the shutter cavity and is spaced from the at least one ramped slide surface. The front face portion is coupled to the receptacle body at a forward end thereof, and substantially covers the shutter cavity and defines a plurality of receptacle openings that are generally aligned with corresponding ones of the electrical contacts. The shutter is movable within the shutter cavity of the receptacle body, and has a first contact surface that is configured to engage the ramped slide surface, plus a second contact surface that is configured to engage the ramped return surface. The shutter is movable between at least one blocking position in which the shutter substantially precludes access to the electrical contacts through the receptacle openings, and a non-blocking position in which the shutter permits access to the electrical contacts through the receptacle openings. The first and second locking surfaces are defined by one or both of the receptacle body and the front face portion, with the first and second locking surfaces defining respective portions of the shutter cavity. The biasing member is disposed at least partially in the shutter cavity and is configured to bias the shutter in a direction toward the front face portion. The shutter is configured to move from the non-blocking position to the at least one blocking position in response to removal of the prongs of the electrical plug from the receptacle openings, thereby causing the second contact surface to engage the ramped return surface in a lateral sliding manner. The shutter is also configured to move from the at least one blocking position to the non-blocking position in response to the prongs of the electrical plug being inserted substantially simultaneously through the receptacle openings, thereby causing the first contact surface to engage the ramped slide surface in a lateral sliding manner. The shutter is further configured to remain in the at least one blocking position in response to an object being inserted into only one of the receptacle openings, thereby causing a portion of the shutter to engage one of the first and second locking surfaces to substantially prevent lateral sliding movement of the shutter.

Thus, the access-restricted electrical receptacle of the present invention provides limited access to its electrical contacts for improved safety. A movable shutter permits access to the electrical contacts by properly-inserted prongs of a plug, but substantially limits or prevents access to the electrical contacts by foreign objects that are inserted into one receptacle opening or the other. The shutter includes a forward surface that is contacted by prongs of a plug or by foreign objects, and includes ramped surfaces that interact with corresponding ramped surfaces in the receptacle to selectively guide and/or block movement of the shutter, which can reduce wear of the shutter and increase the durability of the receptacle.

These and other objects, advantages, purposes and features of the present invention will become apparent upon review of the following specification in conjunction with the drawings.

DESCRIPTION OF THE PREFERRED EMBODIMENTS

An access-restricted electrical receptacle is provided for supplying electrical power, typically 110V AC or 220V AC power, to appliances, lighting, or other electrical consumers that utilize plugs having two or three (or more) prongs. The receptacle includes an internal mechanism that limits or precludes improper contact with electrical contacts housed inside of the receptacle, such as by young children or other persons who may disregard or may be unfamiliar with the risks associated with electrical outlets and contact with electrical current. As will be described in more detail below, the access-restricted electrical receptacle includes a shutter that moves to (or remains in) a locked position when contacted improperly, such as due to insertion of a small object into one of the receptacle openings, in order to block access to the electrical contacts. However, the shutter will move to an open position when the prongs of a plug are properly inserted into at least two of the openings, in order to supply electrical power to the plug and its associated electrical consumer.

Figures 4A, 4B, 4C:
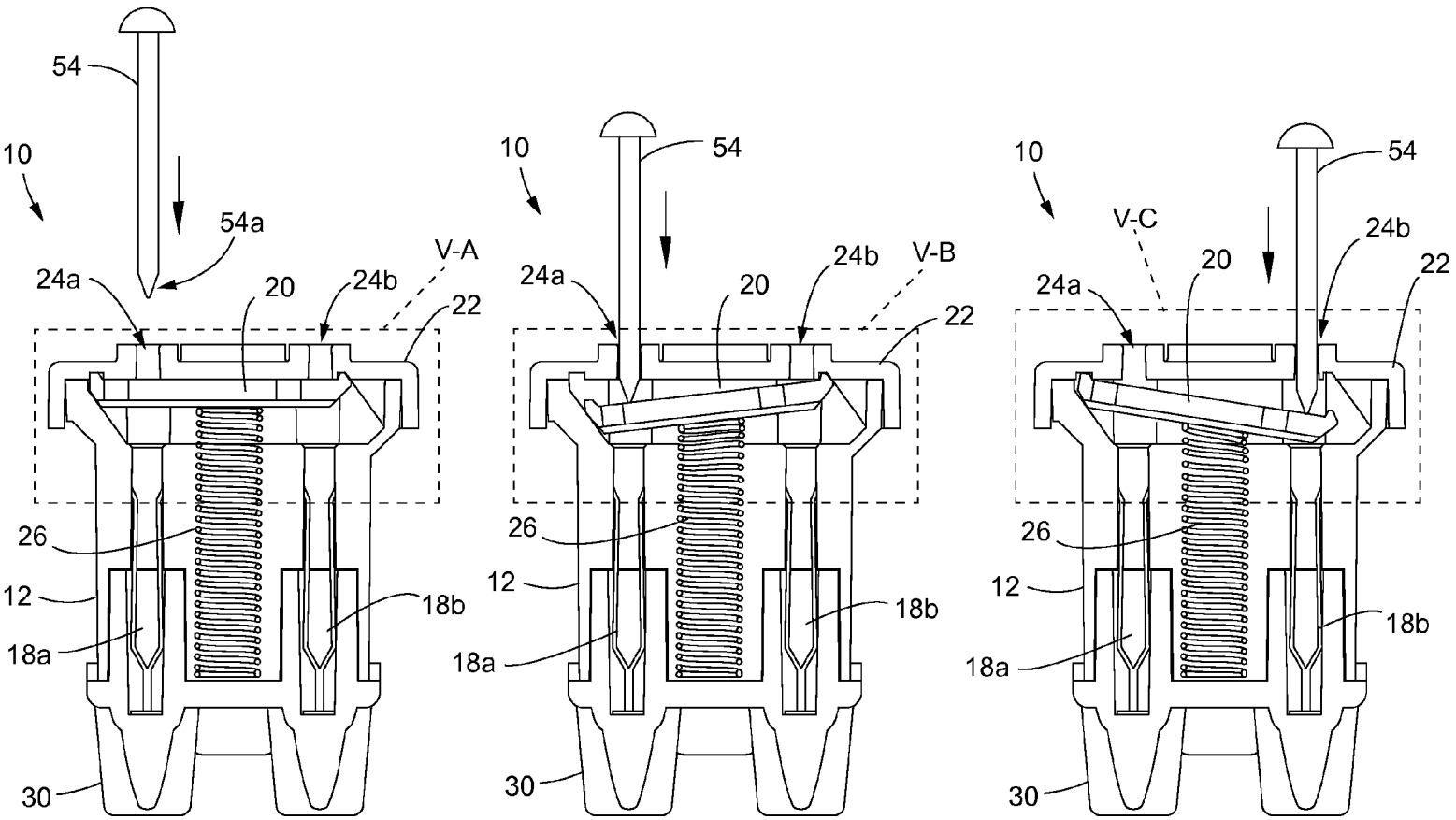
FIG. 4A is a side sectional view of the electrical receptacle assembly of FIG. 2, shown prior to engagement by a single nail.
FIG. 4B is another side sectional view of the electrical receptacle assembly of FIG. 2, in which the nail is shown extending through a first receptacle opening.
FIG. 4C is another side sectional view of the electrical receptacle assembly of FIG. 2, in which the nail is shown extending through a second receptacle opening.

Referring now to the drawings and the illustrative embodiments depicted therein, an access-restricted electrical receptacle or outlet 10 includes a main receptacle body 12 that defines a shutter cavity 14 and receives a plurality of electrical contacts 18 including a hot or "line" contact 18*a*, a neutral contact 18*b*, and a ground contact 18*c* (FIG. 1) that are configured to receive respective prongs of an electrical plug associated with an electrical consumer, such as an appliance, lighting, or the like. Electrical contacts 18 are selectively accessible via the shutter cavity 14 according to the position of a shutter 20 that is movably housed within shutter cavity 14. A front face portion 22 covers or encloses the shutter cavity 14 and defines a plurality of receptacle openings 24*a-c* that are generally aligned with corresponding ones of the electrical contacts 18*a-c*, such as shown in FIGS. 4A-7C. As will be described in more detail below, the shutter 20 interacts with ramped surfaces of the receptacle body 12 and the front face portion 22 to move the shutter in a desired manner, to selectively block and unblock access to the electrical contacts 18 via the receptacle openings 24*a-c*. A biasing member such as a coil spring 26 is received in a spring cavity 28 defined in receptacle body 12, with a forward spring portion 26*a* extending into shutter cavity 14, such as shown in FIGS. 4A-4C.

Figure 1:
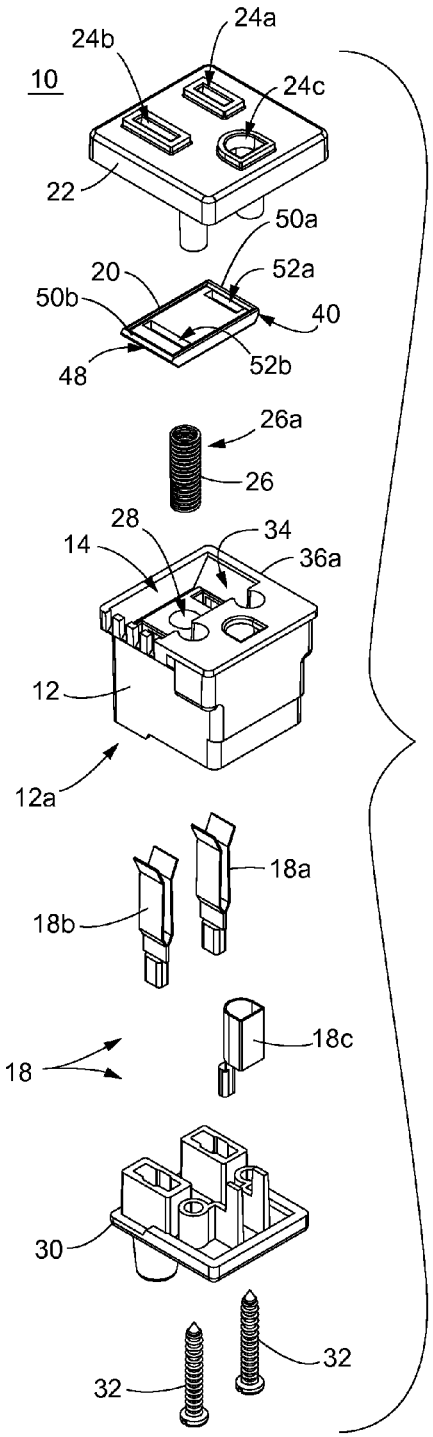
FIG. 1 is an exploded perspective view of an access-restricted electrical receptacle assembly in accordance with the present invention.
Figure 2:
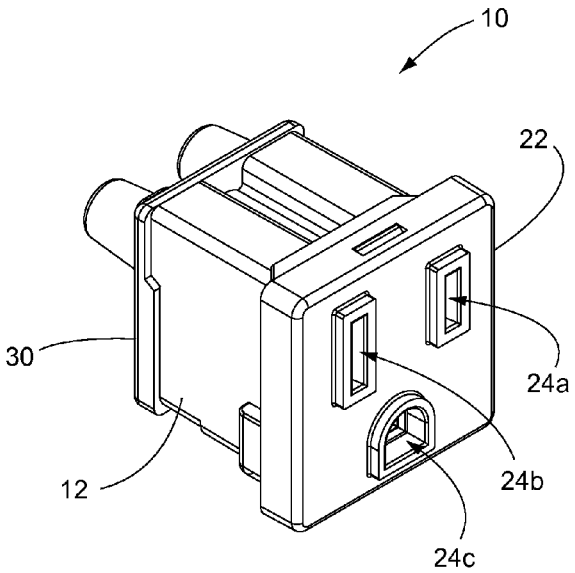
FIG. 2 is a front perspective view of the electrical receptacle assembly of FIG. 1, shown in an assembled state.
Figure 3:
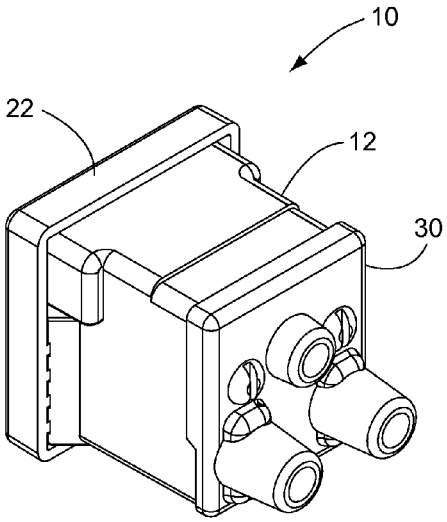
FIG. 3 is a rear perspective view of the electrical receptacle assembly of FIG. 2.

A rear body 30 encloses an open rear portion 12*a* of main receptacle body 12, and is coupled to rear portion 12*a* and front face portion 22 via mechanical fasteners such as screws 32 (FIG. 1). Optionally, the rear body and/or front face portion may be configured to snap-fit into engagement with the main receptacle body without the use of separate fasteners. Moreover, although rear body 30 and main receptacle body 12 are separate components in this illustrated embodiment, it will be appreciated that a single overmold may be used to form a single housing that incorporates the electrical contacts and otherwise has substantially the same shape as if rear body 30 and main receptacle body 12 were unitarily formed.

Main receptacle body 12 defines an angled or ramped slide surface 34 that extends from a first end wall 36*a* to a base surface 38, the ramped slide surface 34, first end wall 36*a*, and base surface 38 all cooperating to define portions of shutter cavity 14, such as shown in FIGS. 1, 5A-5C, and 7A-7C. A corresponding angled or ramped contact surface 40 is formed at an end of shutter 20, and engages ramped slide surface 34 during operation of the shutter 20, such as will be described in more detail below. Front face portion 22 has an inner or rear surface 42 that defines a ramped return surface 44 and first and second locking surfaces or recesses 46*a*, 46*b* in the form of notches that are located outboard of respective receptacle openings 24*a*, 24*b*. Another angled or ramped contact surface 48 is formed at an end of shutter 20, opposite from contact surface 40, and engages ramped return surface 44 during operation of the shutter 20, as will also be described in more detail below.

Figure 5A:
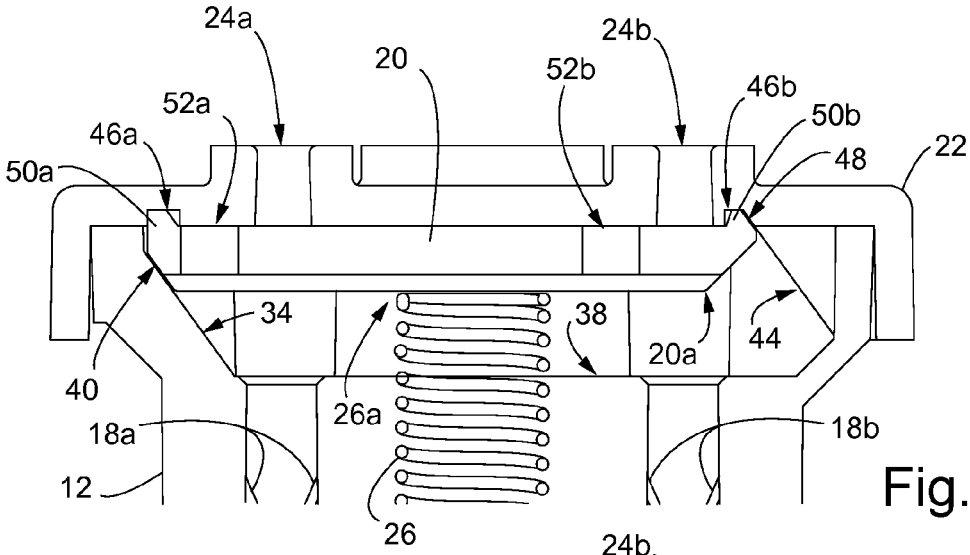
FIGS. 5A-5C are enlarged views of the regions designated V-A, V-B, and V-C in FIGS. 4A-4C, respectively.
Figure 5B:
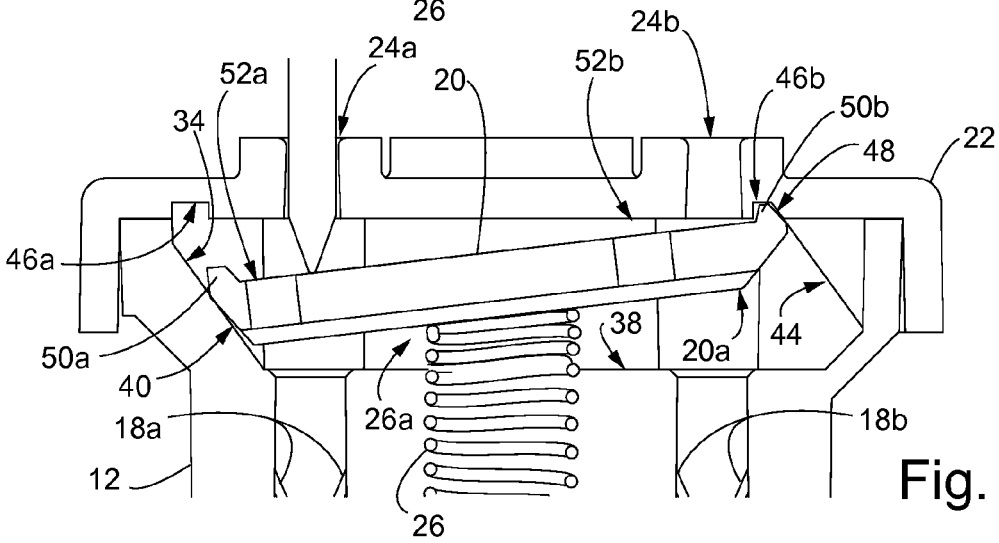
Figure 5C:
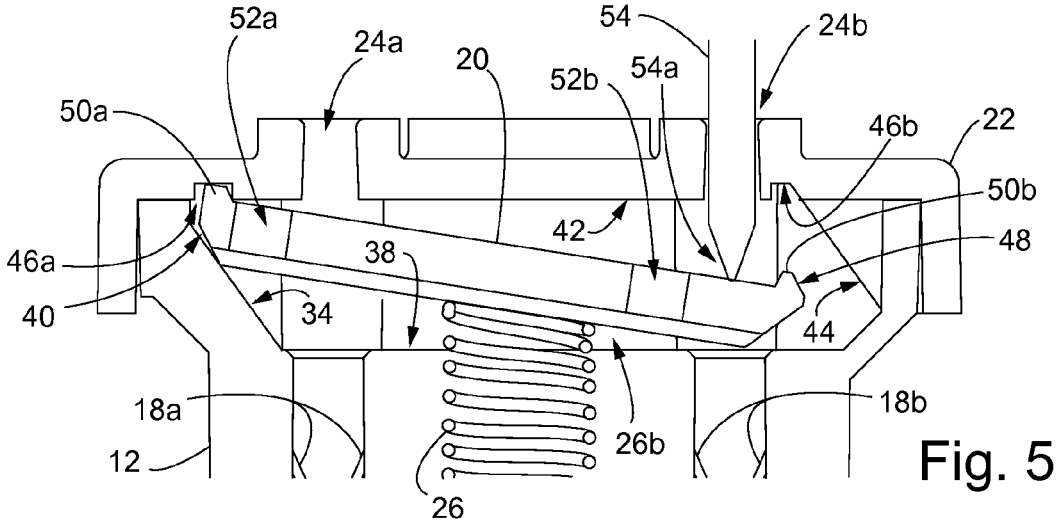
Figures 6A, 6B, 6C:
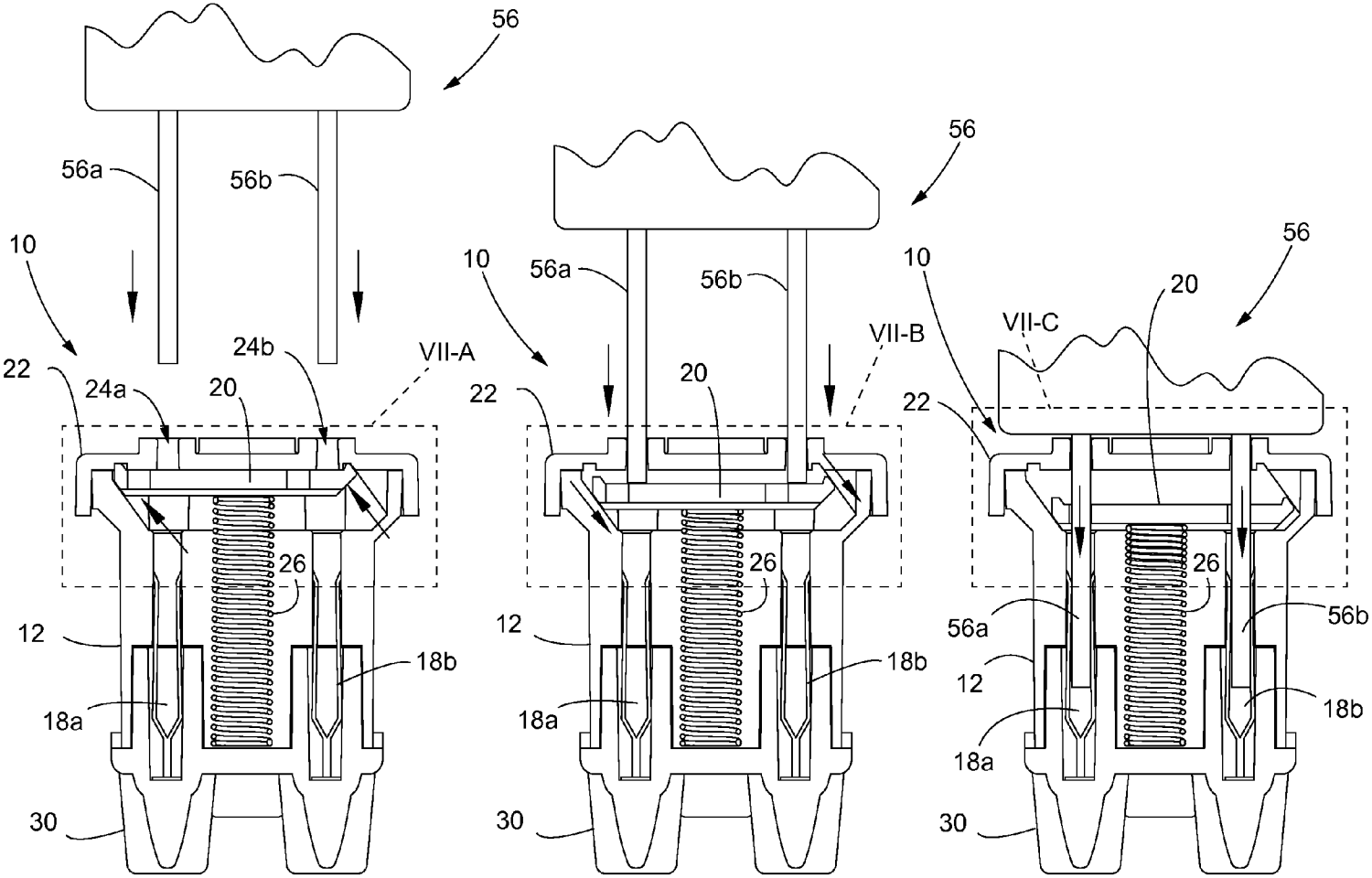
FIGS. 6A-6C are side sectional views of the electrical receptacle assembly of FIG. 2, shown in an assembled state and depicting three stages of inserting a proper two-prong plug into the receptacle.

Shutter 20 further includes first and second raised locking portions 50*a*, 50*b* in the form of ridges that are directed toward front face portion 22 and that extend substantially across the width of the shutter, at the respective opposite end portions thereof (FIGS. 1, 5A-5C, and 7A-7C). Both locking portions 50*a*, 50*b* are received in the respective locking recesses 46*a*, 46*b* when shutter 20 is in a non-engaged blocking position (FIGS. 4A, 5A, 6A, and 7A), while only second locking portion 50*b* is received in its corresponding second locking recess 46*b* when shutter 20 is in a first engaged blocking position (FIGS. 4B and 5B), and only first locking portion 50*a* is received in its corresponding first locking recess 46*a* when shutter 20 is in a second engaged blocking position (FIGS. 4C and 5C). However, as shown in FIGS. 6B and 6C, both locking portions 50*a*, 50*b* disengage their respective locking recesses 46*a*, 46*b* when shutter 20 is moved to its non-blocking position. A pair of slots or openings 52*a*, 52*b* are formed or established in shutter 20, each spaced inwardly from respective locking portions 50*a*, 50*b* (FIGS. 1, 5A-5C, and 7A-7C). Openings 52*a*, 52*b* align with respective ones of the receptacle openings 24*a*, 24*b* and the hot and the neutral electrical contacts 18*a*, 18*b* when shutter 20 is in its non-blocking position (FIGS. 6C and 7C), and openings 52*a*, 52*b* misalign with the receptacle openings 24*a*, 24*b* and the hot and neutral electrical contacts 18*a*, 18*b* when shutter 20 is in one of its blocking positions (FIGS. 4A-6B, 7A, and 7B).

Referring now to FIGS. 4A-4B and 5A-5B, when a foreign object 54 (such as a nail, pin, paperclip, small screwdriver or knife, or other small object) is inserted into a first receptacle opening 24*a* (corresponding to hot contact 18*a*), a tip 54*a* of the foreign object 54 contacts shutter 20 at a location spaced inboard of opening 52*a*. When pressure is applied to shutter 20 by foreign object 54 at this location, first locking portion 50*a* disengages first locking recess 46*a* and shutter 20 pivots about second locking portion 50*b* until ramped contact surface 40 of shutter 20 contacts ramped slide surface 34 of main receptacle body 12, at which point shutter 20 is substantially precluded from further movement (in part by ramped slide surface 34 and in part by locking portion 50*b* engaged in locking recess 46*b*), and opening 52*a* remains misaligned with receptacle opening 24*a* and foreign object 54, which precludes further inward movement of the foreign object toward hot electrical contact 18*a* (FIGS. 4B and 5B). If foreign object 54 is subsequently removed, shutter 20 pivots back to the blocking position of FIGS. 4A and 5A under the biasing force of spring 26, which is maintained in compression.

Similarly, when foreign object 54 is inserted into a second receptacle opening 24*b* (corresponding to neutral contact 18*b*), the tip 54*a* of the foreign object 54 contacts shutter 20 at a location spaced outboard of opening 52*b*. As shown in FIGS. 4C and 5C, when pressure is applied to shutter 20 by foreign object 54 at this location, locking portion 50*b* disengages locking recess 46*b* and shutter 20 pivots about locking portion 50*a* until a rear corner surface 20*a* of shutter 20 contacts base surface 38 of main receptacle body 12, at which point shutter 20 is substantially precluded from further movement (in part by base surface 38 and in part by locking portion 50*a* engaged in locking recess 46*a*), and opening 52*b* remains misaligned with receptacle opening 24*b* and foreign object 54, which precludes further inward movement of the foreign object toward neutral electrical contact 18*b*. If foreign object 54 is subsequently removed from receptacle opening 24*b*, shutter 20 pivots back to the blocking position of FIGS. 4A and 5A under the biasing force of spring 26.

Figure 7A:
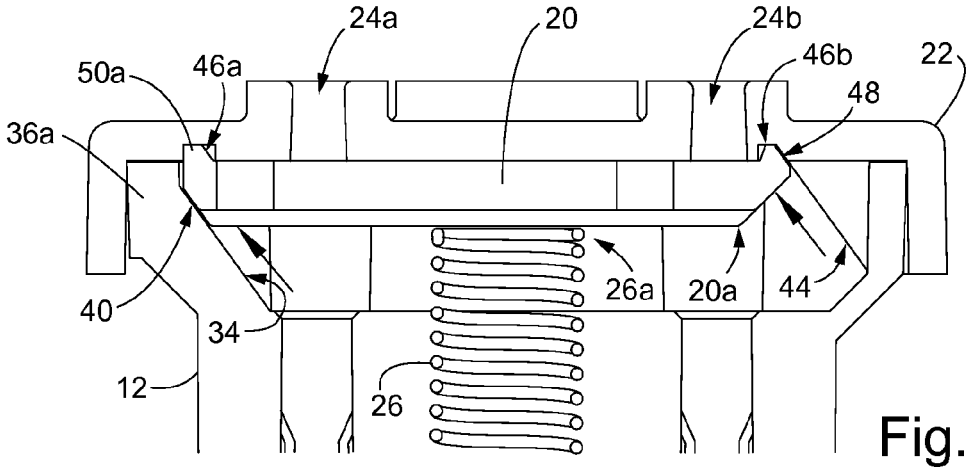
FIGS. 7A-7C are enlarged views of the regions designated VII-A, VII-B, and VII-C in FIGS. 6A-6C, respectively.
Figure 7B:
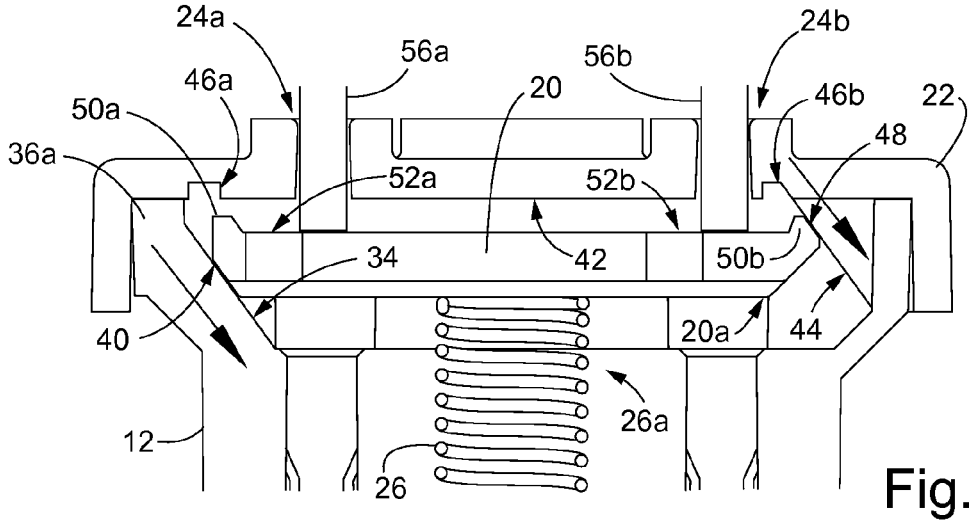
Figure 7C:
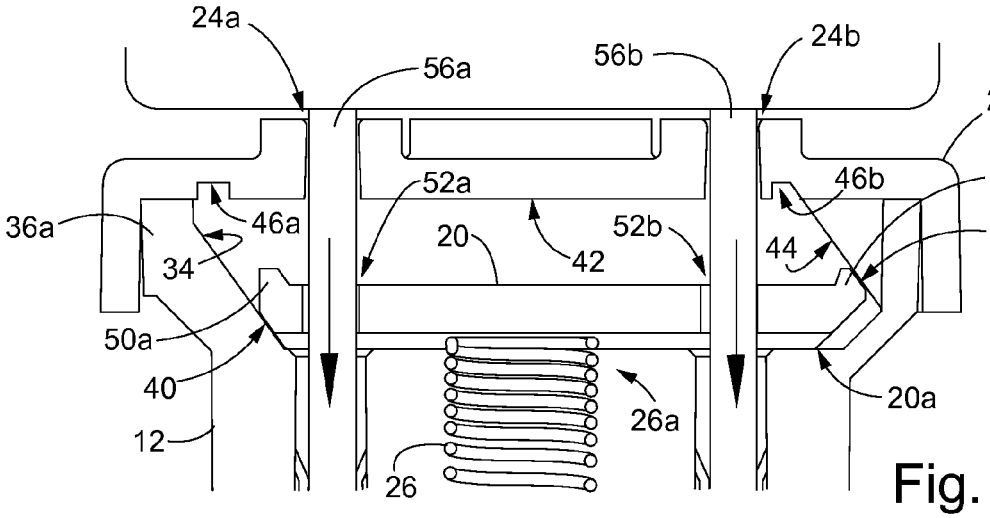

Referring now to FIGS. 6A-7C, when a pair of prongs 56*a*, 56*b* of an electrical plug 56 are simultaneously inserted into first and second receptacle openings 24*a*, 24*b*, the tips of prongs 56*a*, 56*b* contact shutter 20 at respective locations spaced inboard of first opening 52*a* and outboard of second opening 52*b*. When pressure is applied to shutter 20 by prongs 56*a*, 56*b* at these locations simultaneously, locking portions 50*a*, 50*b* disengage locking recesses 46*a*, 46*b* and shutter 20 moves rearwardly (i.e., toward base surface 38) and is simultaneously biased laterally (indicated by a pair of diagonal arrows in FIGS. 6B and 7B) via sliding engagement of the shutter's ramped contact surface 40 with ramped slide surface 34. This movement of shutter 20 continues until openings 52*a*, 52*b* align with prongs 56*a*, 56*b*, thus allowing the prongs to slide through openings 52*a*, 52*b* and engage the respective electrical contacts 18*a*, 18*b* upon the application of sufficient force to overcome friction and the biasing force of spring 26 (FIGS. 6C and 7C). Upon subsequent removal of prongs 56*a*, 56*b*, shutter 20 returns to the blocking position of FIGS. 6A and 7A under the biasing force of spring 26, and due to sliding engagement of ramped contact surface 48 with ramped return surface 44, such as indicated by diagonal arrows in FIGS. 6A and 7A.

Figure 8:
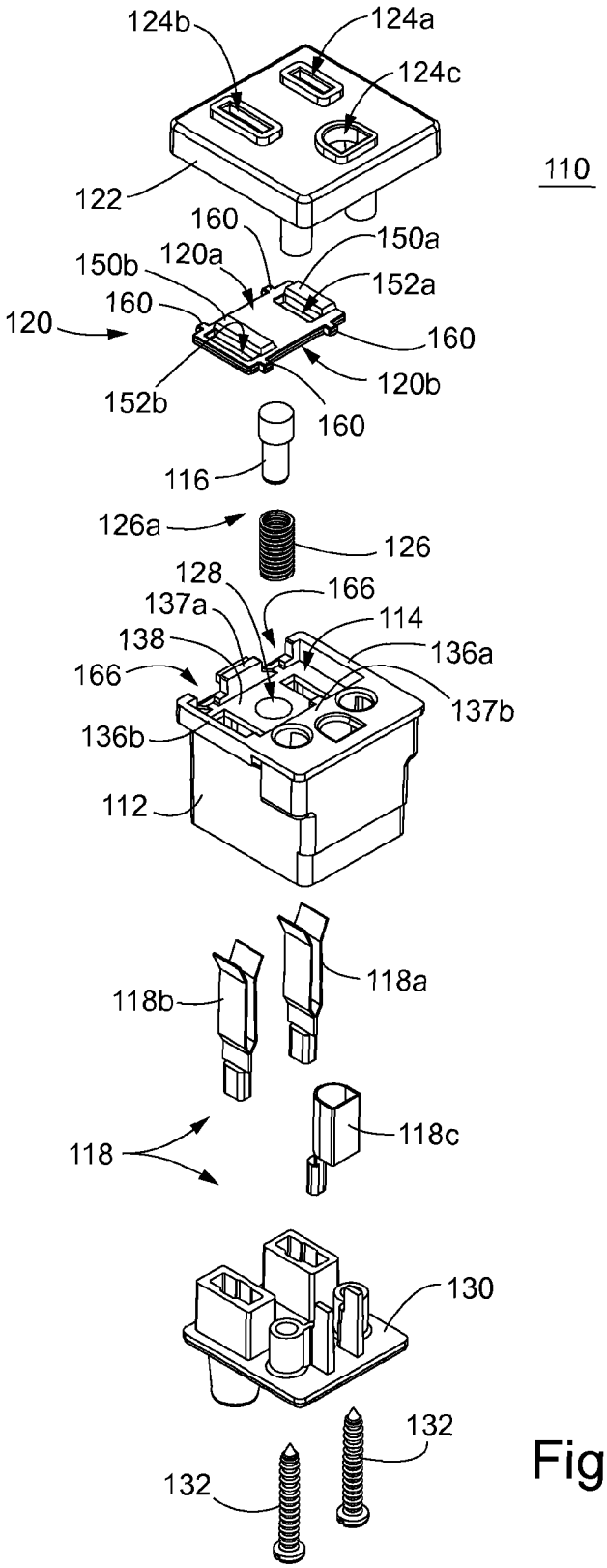
FIG. 8 is an exploded perspective view of another access-restricted electrical receptacle assembly in accordance with the present invention.

Optionally, access-restricted electrical receptacle may have a shutter mechanism with a different arrangement of guide surfaces configured to achieve similar operation as described above. For example, and with reference to FIGS. 8-12C, another access-restricted electrical receptacle 110 includes a main receptacle body 112 that defines a shutter cavity 114 and receives a plurality of electrical contacts 118 including a hot or "line" contact 118*a*, a neutral contact 118*b*, and a ground contact 118*c* (FIG. 8). A front face portion 122 covers or encloses the shutter cavity 114 and defines a plurality of receptacle openings 124*a-c* that are generally aligned with corresponding ones of the electrical contacts 118*a-c*, such as shown in FIGS. 9A-12C. A shutter 120 includes two wing-like projections 160 extending laterally outwardly from opposite side portions 120*a*, 120*b* of the shutter. In the illustrated embodiment, each wing-like projection 160 has an outer surface including generally flat upper and lower surface portions, with rounded convex edge or side surface portions, such as shown in FIGS. 10A-10C and 12A-12C. As will be described in more detail below, the outer surfaces of projections 160 contact and slide along other guiding surfaces of the receptacle during operation, to selectively block and unblock access to the electrical contacts 118*a*, 118*b* through receptacle openings 124*a*, 124*b*.

A biasing member such as a coil spring 126 is received in a spring cavity 128 defined in receptacle body 112, with a forward spring portion 126*a* extending into shutter cavity 114 and optionally having a tip member 116 for engaging a rear surface of the shutter 120, such as shown in FIGS. 9A-12C. A rear body 130 encloses an open rear portion 112*a* of main receptacle body 112, and is coupled to rear portion 112*a* and front face portion 122 via mechanical fasteners such as screws 132 (FIG. 8).

Main receptacle body 112 includes a pair of opposite end walls 136*a*, 136*b* and a pair of opposite side walls 137*a*, 137*b* that cooperate with one another and with a base surface 138 to define rear, side, and end portions of shutter cavity 114, such as shown in FIG. 1. Opposite side portions 120*a*, 120*b* are positioned adjacent the respective side walls 137*a*, 137*b* when shutter 120 is installed in shutter cavity 114. Each side wall 137*a*, 137*b* defines a pair of notches 166 with respective ramped slide surfaces 134 that are selectively engaged by respective projections 160 during operation of the shutter 120 (FIGS. 10A-10C and 12A-12C). Ramped slide surfaces 134 guide or direct the movement of shutter 120 when prongs 156*a*, 156*b* of a plug 156 are inserted into the receptacle openings 124*a*, 124, such as described below with reference to FIGS. 11A-12C. Ramped slide surfaces 134 also serve to limit the movement of shutter 120 when a foreign object 154 is inserted into one of the receptacle openings 124*a*, 124*b*, such as described below with reference to FIGS. 9A-10C.

Front face portion 122 includes a set of four ramped return surfaces 144 that project rearwardly from a rear surface 142 of the front face portion 122 and into shutter cavity 114, such as shown in FIGS. 10A-10C and 12A-12C. Ramped return surfaces 144 are spaced from (and substantially parallel to) respective ones of the ramped slide surfaces 134 when front face portion 122 is assembled to main receptacle body 112, thus providing a channel or space between each ramped return surface 144 and a corresponding ramped slide surface 134 to permit movement of projections 160 of shutter 120. Ramped return surfaces 144 guide or direct the movement of shutter 120 when prongs 156*a*, 156*b* of a plug 156 are removed from the receptacle openings 124*a*, 124*b*. First and second recesses 146*a*, 146*b* are formed in rear surface 142, and provide clearance for receiving respective forward corner portions of shutter 120 when the shutter is pivoted in response to a foreign object 154 being inserted into one of the receptacle openings 124*a*, 124*b*, such as shown in FIGS. 9B, 9C, 10B, and 10C.

Figures 9A, 9B, 9C:
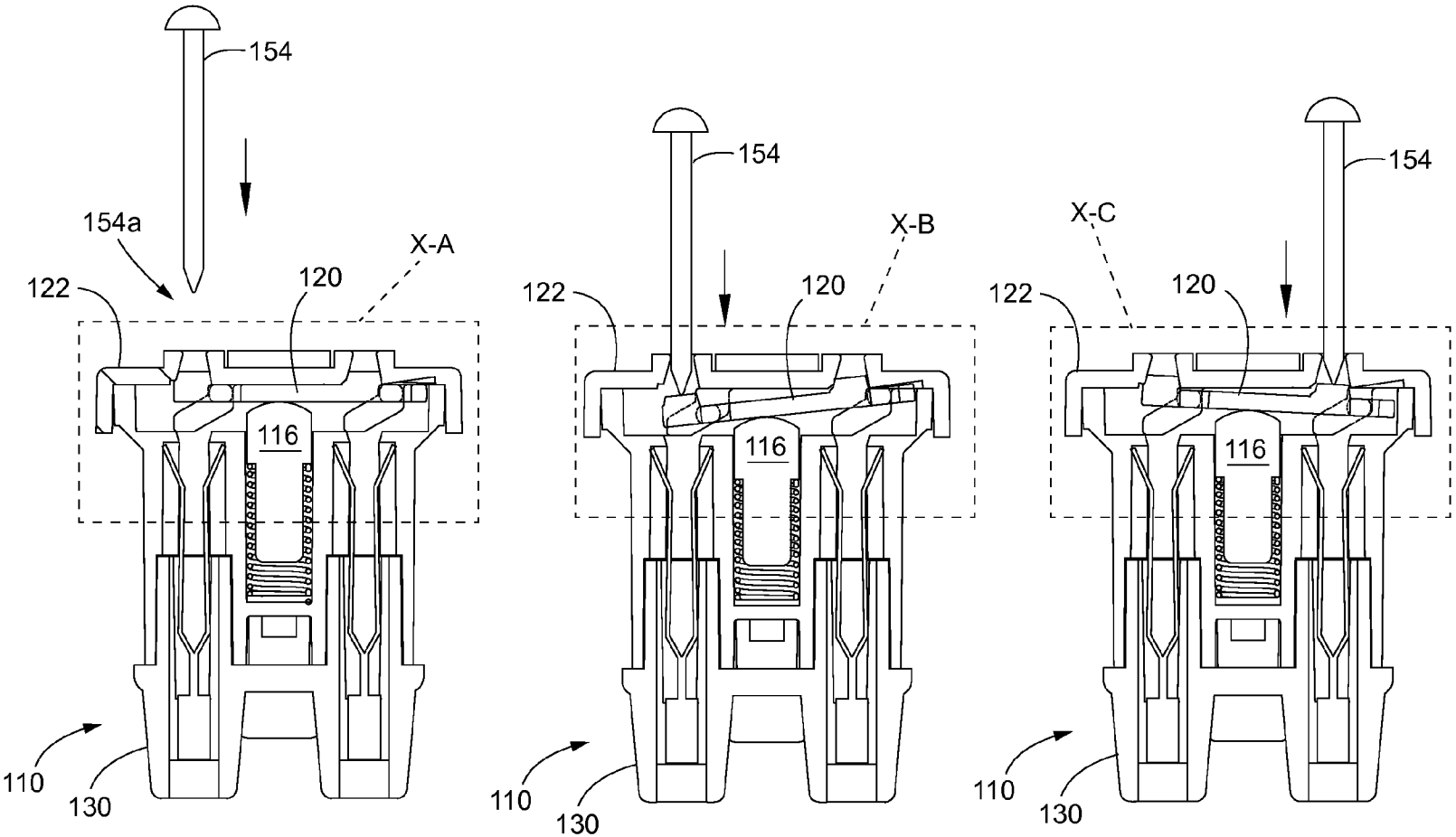
FIG. 9A is a side sectional view of the electrical receptacle assembly of FIG. 8, shown in an assembled state and prior to engagement by a single nail.
FIG. 9B is another side sectional view of the electrical receptacle assembly of FIG. 8, in which the nail is shown extending through a first receptacle opening.
FIG. 9C is another side sectional view of the electrical receptacle assembly of FIG. 8, in which the nail is shown extending through a second receptacle opening.

Shutter 120 further includes first and second raised locking portions 150*a*, 150*b* in the form of flat-topped ridges that are directed toward front face portion 122 and extend across at least a portion of the width of the shutter. When shutter 120 is in the blocking position of FIGS. 9A, 10A, 11A, and 12A, raised locking portions 150*a*, 150*b* both extend partially into rear portions of respective receptacle openings 124*a*, 124*b*, which may provide a sealing function against intrusion of splashed liquids or other contaminants into shutter cavity 114. Only second locking portion 150*b* remains in its corresponding receptacle opening 124*b* when shutter 120 is in a first engaged blocking position (FIGS. 9B and 10B), while only first locking portion 150*a* remains in its corresponding receptacle opening 124*a* when shutter 120 is in a second engaged blocking position (FIGS. 9C and 10C). However, as shown in FIGS. 11B and 11C, both locking portions 150*a*, 150*b* disengage their respective receptacle openings when shutter 120 is moved to its non-blocking position. A pair of slots or openings 152*a*, 152*b* are formed or established in shutter 120, with first opening 152*a* spaced inboard of first locking portion 150*a*, and with second opening 152*b* spaced outboard of second locking portion 150*b*. Openings 152*a*, 152*b* align with respective ones of the receptacle openings 124*a*, 124*b* and the hot and the neutral electrical contacts 118*a*, 118*b* when shutter 120 is in its non-blocking position (FIGS. 11C and 12C), and openings 152*a*, 152*b* misalign with the receptacle openings 124*a*, 124*b* and the hot and neutral electrical contacts 118*a*, 118*b* when shutter 120 is in one of its blocking positions of FIGS. 9A-11B, 12A, and 12B.

Figure 10A:
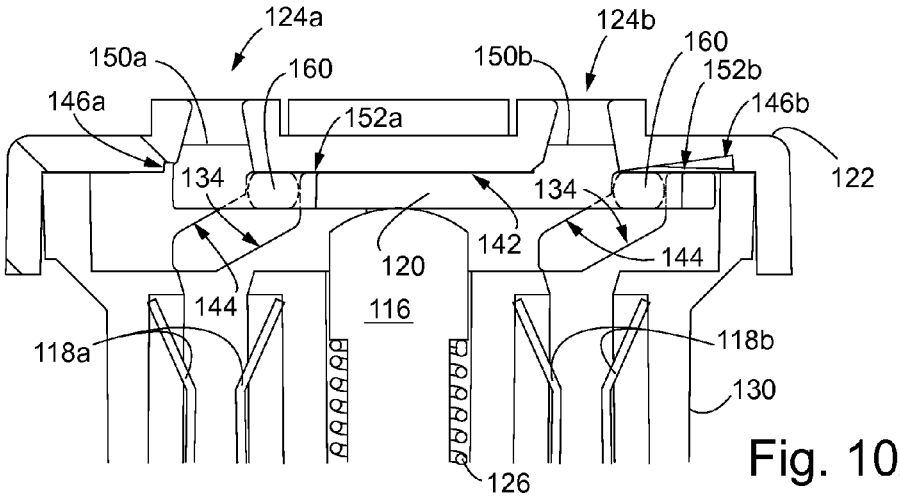
FIGS. 10A-10C are enlarged views of the regions designated X-A, X-B, and X-C in FIGS. 9A-9C, respectively.
Figure 10B:
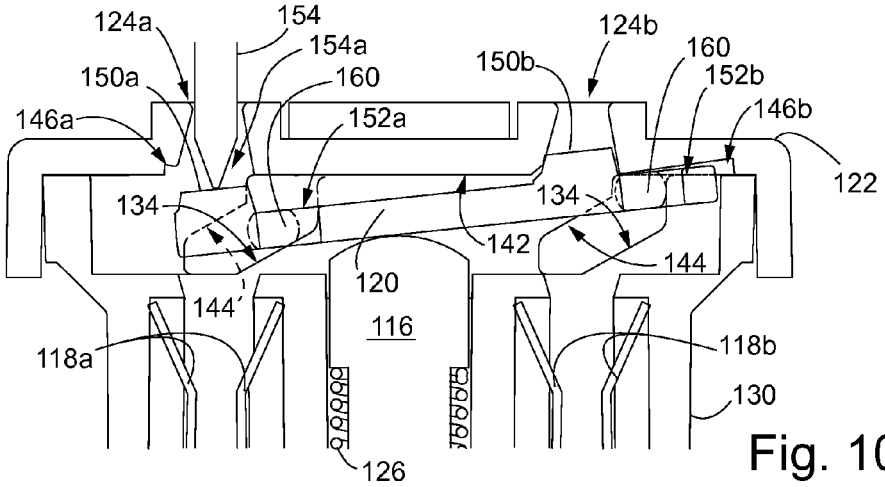
Figure 10C:
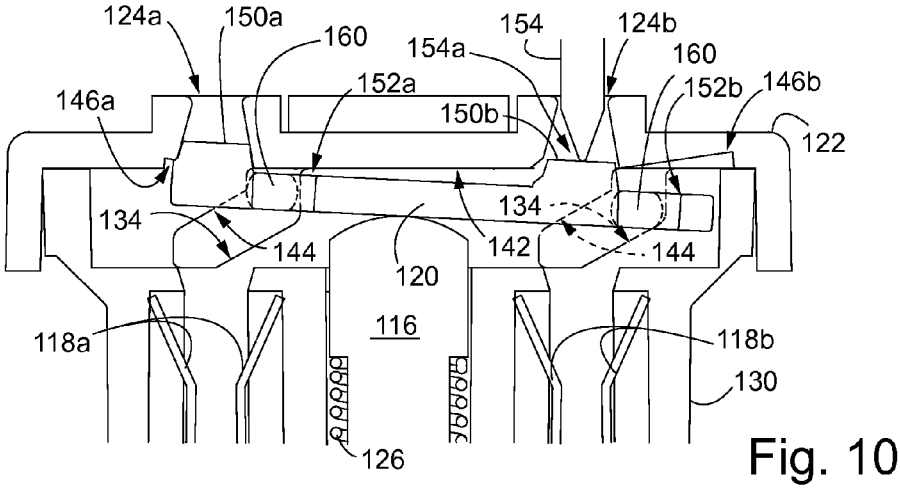
Figures 11A, 11B, 11C:
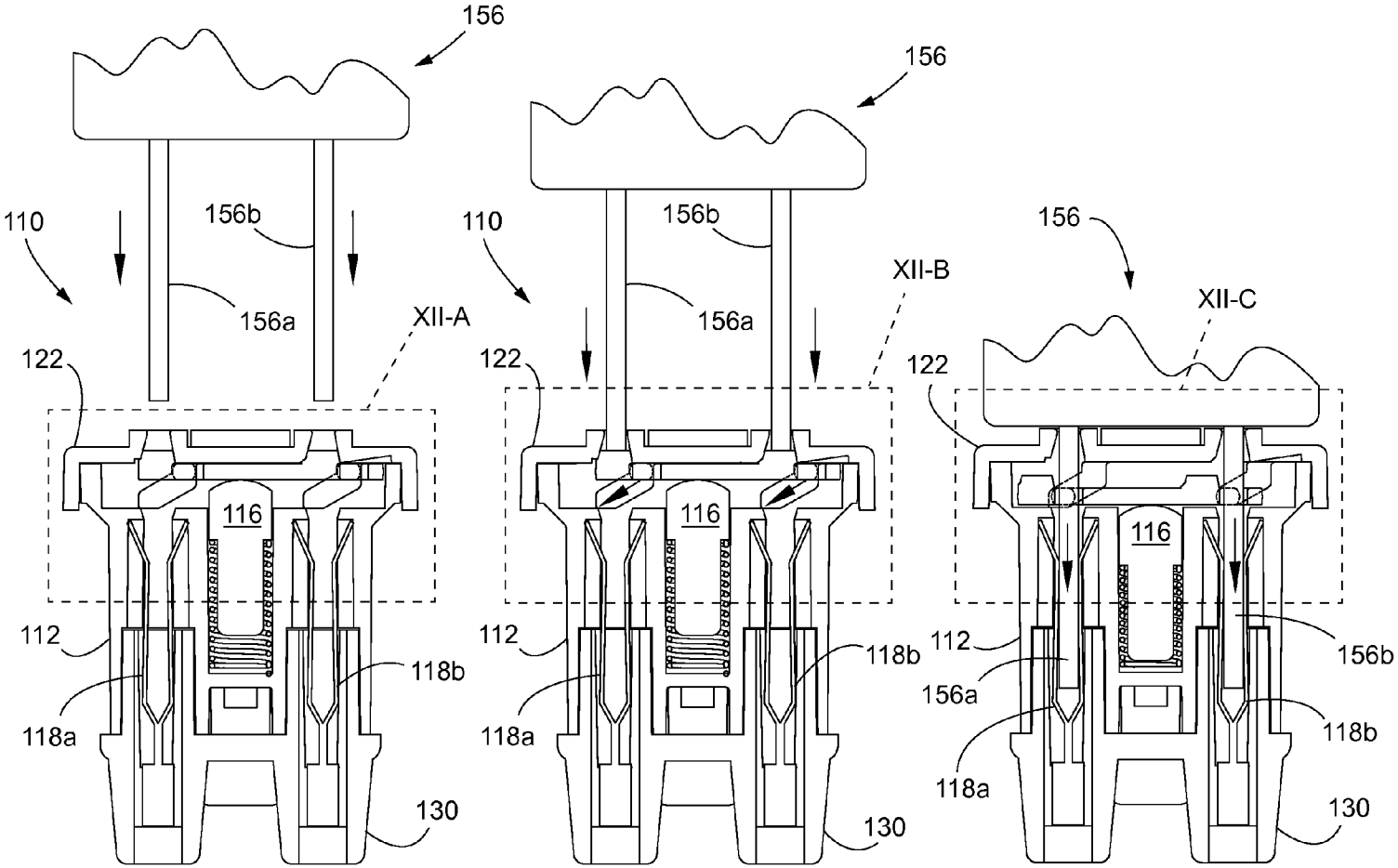
FIGS. 11A-11C are side sectional views of the electrical receptacle assembly of FIG. 8, shown in an assembled state and depicting three stages of inserting a proper two-prong plug into the receptacle.

Referring now to FIGS. 9A, 9B, 10A, and 10B, when a foreign object 154 is inserted into a first receptacle opening 124*a* (corresponding to hot contact 118*a*), a tip 154*a* of the foreign object 154 contacts shutter 120 at locking portion 150*a*. When pressure is applied to shutter 120 by foreign object 154 at locking portion 150*a*, the first locking portion 150*a* disengages receptacle opening 124*a* and shutter 120 pivots about second locking portion 150*b* until the two projections 160 nearest first locking portion 150*a* contact ramped slide surfaces 134, at which point shutter 120 is substantially precluded from further movement (in part by ramped slide surface 134 and in part by second locking portion 150*b* engaged in receptacle opening 124*b*) and first opening 152*a* remains misaligned with first receptacle opening 124*a* and foreign object 154, which precludes further inward movement of the foreign object toward hot electrical contact 118*a* (FIGS. 9B and 10B). If foreign object 154 is subsequently removed, shutter 120 pivots back to the blocking position of FIGS. 9A and 10A under the biasing force of spring 126, which is maintained in compression.

Similarly, when foreign object 154 is inserted into a second receptacle opening 124*b* (corresponding to neutral contact 118*b*), the tip 154*a* of the foreign object 154 contacts shutter 120 at second locking portion 150*b*. As shown in FIGS. 9C and 10C, when pressure is applied to shutter 120 by foreign object 154 at second locking portion 150*b*, second locking portion 150*b* disengages second receptacle opening 124*b* and shutter 120 pivots about first locking portion 150*a* until the two projections 160 nearest second locking portion 150*b* contact the corresponding ramped slide surfaces 134, at which point shutter 120 is substantially precluded from further movement (in part by ramped slide surfaces 134 and in part by first locking portion 150*a* engaged in first receptacle opening 124*a*) and second opening 152*b* remains misaligned with second receptacle opening 124*b* and foreign object 154, which precludes further inward movement of the foreign object 154 toward hot electrical contact 118*a* (FIGS. 9C and 10C). If foreign object 154 is subsequently removed from second receptacle opening 124*b*, shutter 120 pivots back to the blocking position of FIGS. 9A and 10A under the biasing force of spring 26.

Figure 12A:
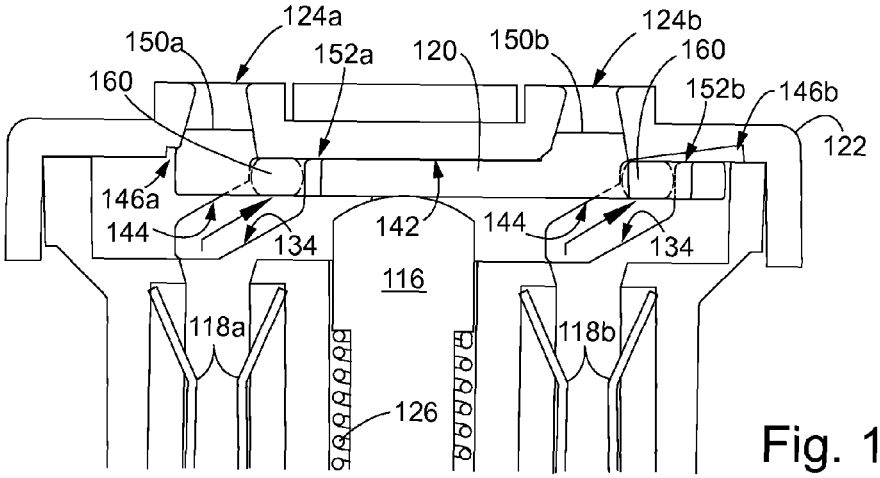
FIGS. 12A-12C are enlarged views of the regions designated XII-A, XII-B, and XII-C in FIGS. 11A-11C, respectively.
Figure 12B:
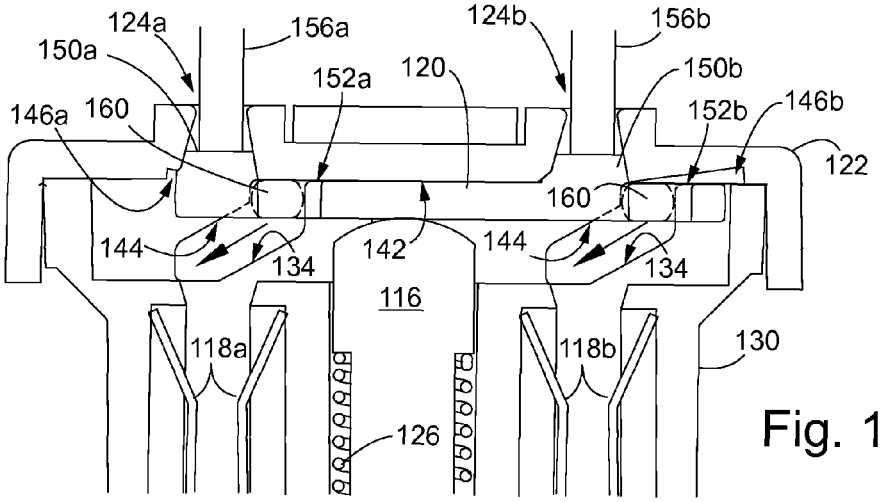
Figure 12C:
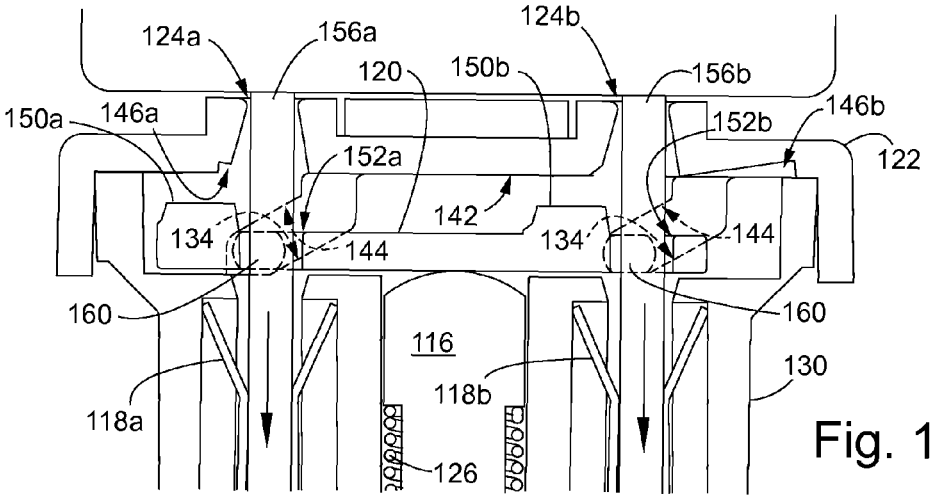

Referring now to FIGS. 11A-12C, when two prongs 156*a*, 156*b* of an electrical plug 156 are simultaneously inserted into first and second receptacle openings 124*a*, 124*b*, tips of prongs 156*a*, 156*b* contact shutter 120 at respective ones of the locking portions 150*a*, 150*b*. When pressure is applied to shutter 120 by prongs 156*a*, 156*b* at both locking portions 150*a*, 150*b* simultaneously, locking portions 150*a*, 150*b* disengage receptacle openings 124*a*, 124*b* and shutter 120 moves rearwardly (i.e., toward base surface 138) and is simultaneously biased laterally (indicated by a pair of diagonal arrows in FIGS. 11B and 12B) via sliding engagement of all four of the shutter's projections 160 with the corresponding ramped slide surfaces 134. This movement of shutter 120 continues until openings 152*a*, 152*b* align with prongs 156*a*, 156*b*, thus allowing the prongs to slide through openings 152*a*, 152*b* and engage the respective electrical contacts 118*a*, 118*b* upon the application of sufficient force to overcome friction and the biasing force of spring 126 (FIGS. 11C and 12C). Upon subsequent removal of prongs 156*a*, 156*b*, shutter 120 returns to the blocking position of FIGS. 11A and 12A under the biasing force of spring 126, and due to sliding engagement of all four projections 160 with respective ramped return surfaces 144, such as indicated by diagonal arrows in FIG. 12A.

Figure 13:
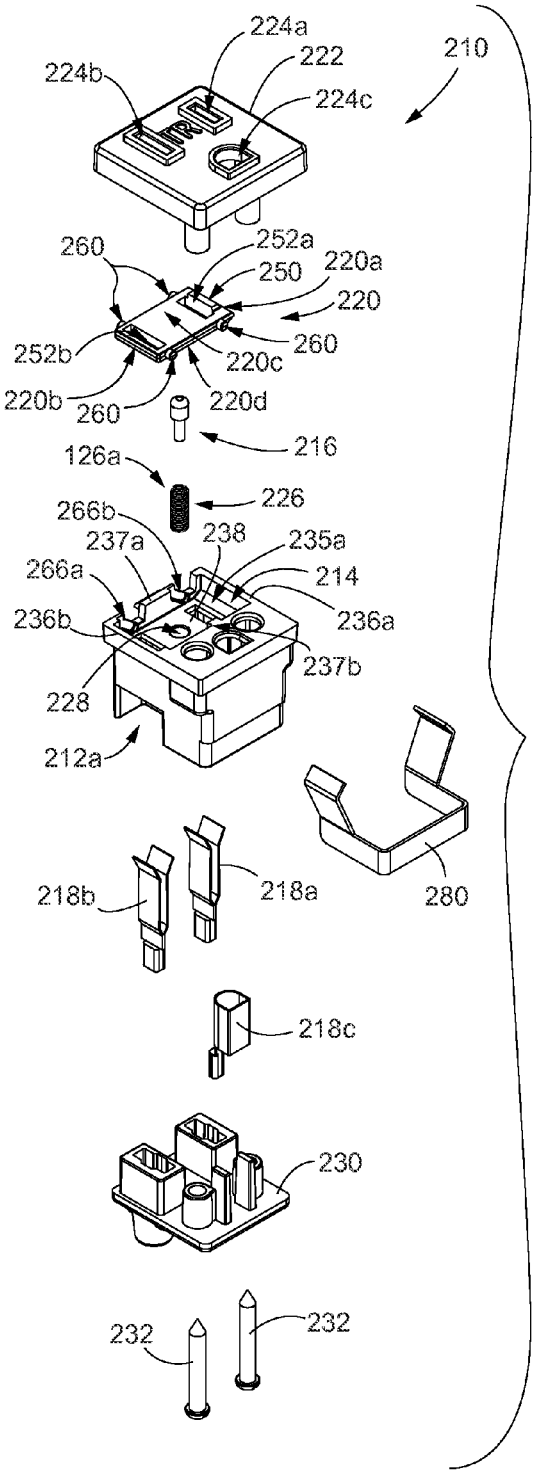
FIG. 13 is an exploded perspective view of another access-restricted electrical receptacle assembly in accordance with the present invention.
Figure 14:
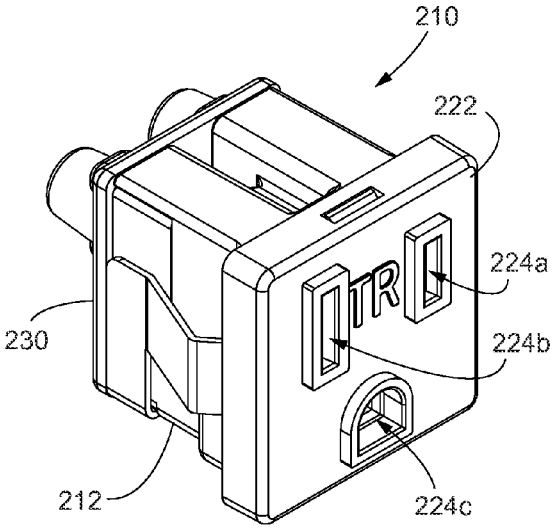
FIG. 14 is a front perspective view of the electrical receptacle assembly of FIG. 13, shown in an assembled state.
Figure 15:
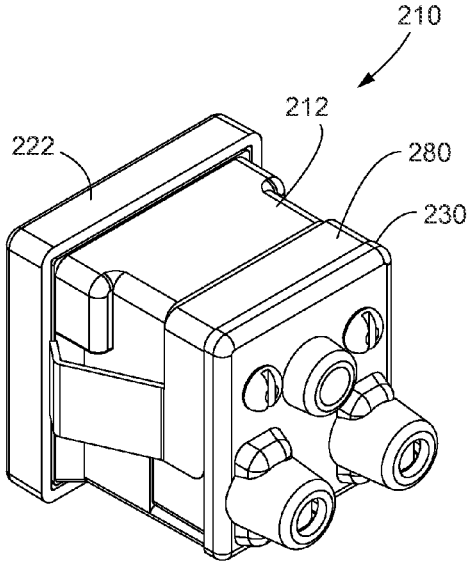
FIG. 15 is a rear perspective view of the electrical receptacle assembly of FIG. 14

Optionally, it is envisioned that an access-restricted electrical receptacle or outlet could include a combination of features to enhance or facilitate the movement of a shutter within a receptacle body. For example, and as shown in FIGS. 13 and 16A-19B, another access-restricted electrical receptacle or outlet 210 may be considered, in some respects, to be a hybrid of the outlets 10, 110 described above. Electrical outlet 210 includes a main receptacle body 212 that defines a shutter cavity 214 and receives a plurality of electrical contacts 218 including a hot or "line" contact 218*a*, a neutral contact 218*b*, and a ground contact 218*c* (FIG. 13). A front face portion 222 covers or encloses the shutter cavity 214 and defines a plurality of receptacle openings 224*a-c* that are generally aligned with corresponding ones of the electrical contacts 218*a-c*, such as shown in FIGS. 16A-16C, 18A, and 18B.

A shutter 220 includes first and second nose or end portions 220*a*, 220*b* and two wing-like projections 260 that extend laterally outwardly from opposite side portions 220*c*, 220*d* of the shutter 220. In the illustrated embodiment, each wing-like projection 260 has an outer surface that is generally cylindrical in shape, such as shown in FIGS. 13, 17A-17C, 19A, and 19B. As will be described in more detail below, the outer surfaces of projections 260 contact and slide along other guiding surfaces of the receptacle during operation, to facilitate selective blocking and unblocking of access to the electrical contacts 218*a*, 218*b* through receptacle openings 224*a*, 224*b*.

A biasing member such as a coil spring 226 is received in a spring cavity 228 that is defined in receptacle body 212, with a forward spring portion 226*a* extending into shutter cavity 214, and optionally having a tip member 216 for engaging a rear surface of the shutter 220, such as shown in FIGS. 16A-16C, 18A, and 18B. A rear body 230 encloses an open rear portion 212*a* of main receptacle body 212, and is coupled to rear portion 212*a* and front face portion 222 via mechanical fasteners such as screws 232 (FIG. 13).

Main receptacle body 212 includes a pair of opposite end walls 236*a*, 236*b* and a pair of opposite side walls 237*a*, 237*b* that cooperate with one another and with a base surface 238 to define rear, side, and end portions of shutter cavity 214, such as shown in FIG. 13. Opposite side portions 220*c*, 220*d* of shutter 220 are positioned adjacent the respective side walls 237*a*, 237*b* when shutter 220 is installed in shutter cavity 214. Each side wall 237*a*, 237*b* defines lower portions or ramped slide surfaces 234*a*, 234*b* of a pair of diagonal sloped slots 266*a*, 266*b* (FIGS. 17A-17C, 19A, and 19C) that are selectively engaged by respective projections 260 during operation of the shutter 220. The ramped slide surfaces 234*a*, 234*b* are spaced from respective ones of a set of four ramped return surfaces 244 that project rearwardly from a rear surface of the front face portion 222 and into shutter cavity 214 to define slots 266*a*, 266*b*. Slots 266*a*, 266*b* are engaged by respective projections 260 of shutter 220, to guide or direct the movement of shutter 220 when prongs 256*a*, 256*b* of a plug 256 are inserted into the receptacle openings 224*a*, 224*b* (FIGS. 17A-17C and 19A-19B). Base surface 238 defines additional first and second ramped base surfaces 235*a*, 235*b* (FIGS. 13, 16A-16C, 19A, and 19B) that, under certain conditions (described below), are selectively engaged by a respective one of first and second nose or end portions 220*a*, 220*b* of shutter 220.

Figures 16A, 16B, 16C:
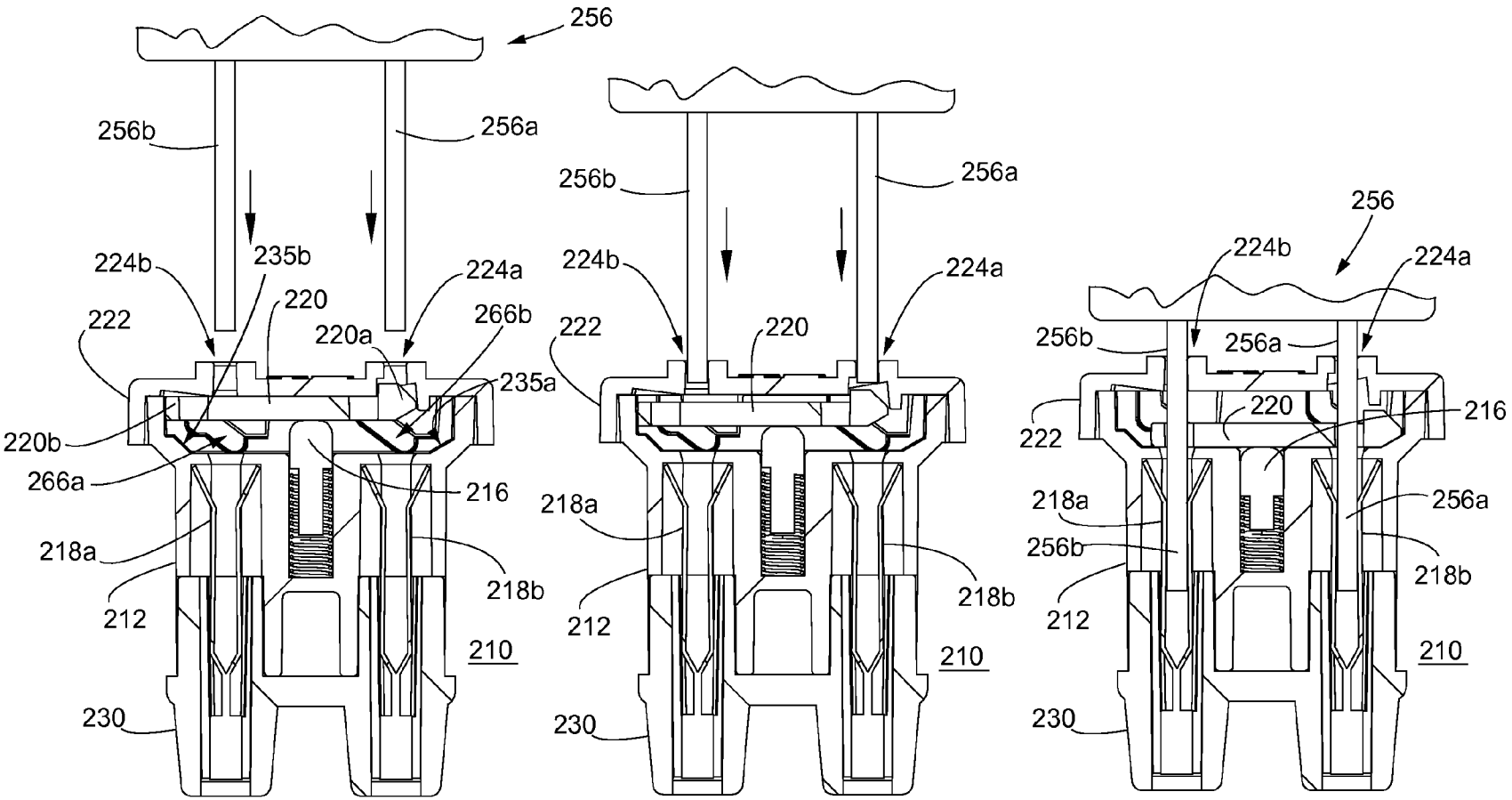
FIGS. 16A-16C are side sectional views of the electrical receptacle assembly of FIG. 14, taken along a plane extending through first and second receptacle openings thereof, and depicting three stages of inserting a proper two-prong plug into the receptacle assembly.
Figure 17A:
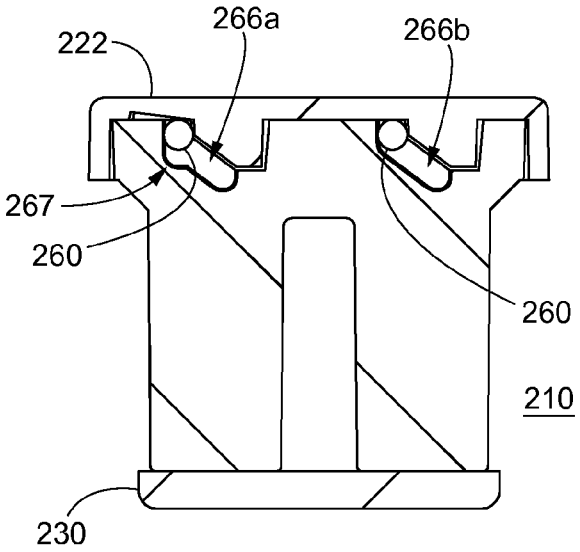
FIGS. 17A-17C are additional side sectional views corresponding to FIGS. 16A-16C, respectively, and taken along a plane that is spaced outboard of the plane of FIGS. 16A-16C.
Figure 17B:
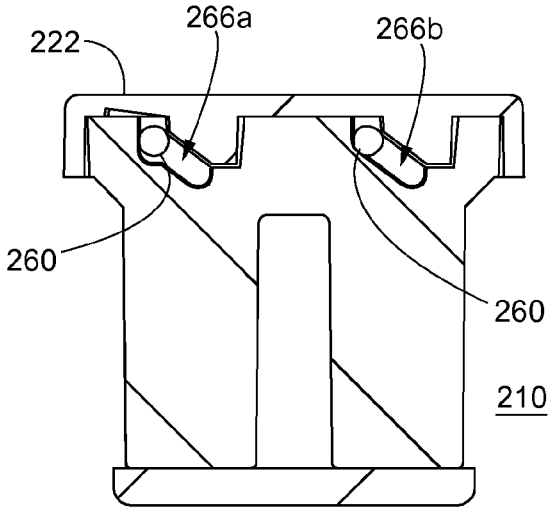
Figure 17C:
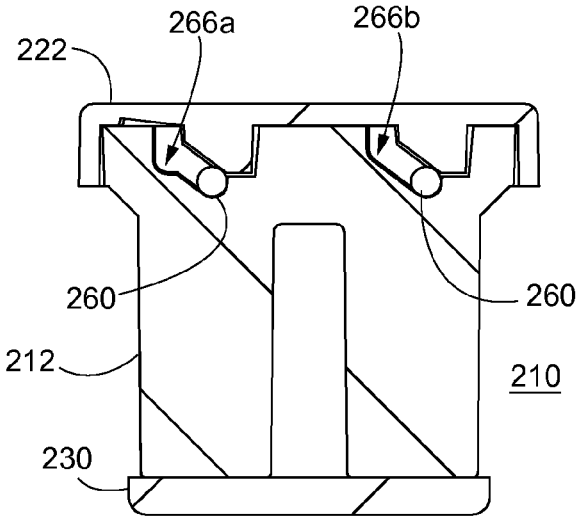
Figure 18B:
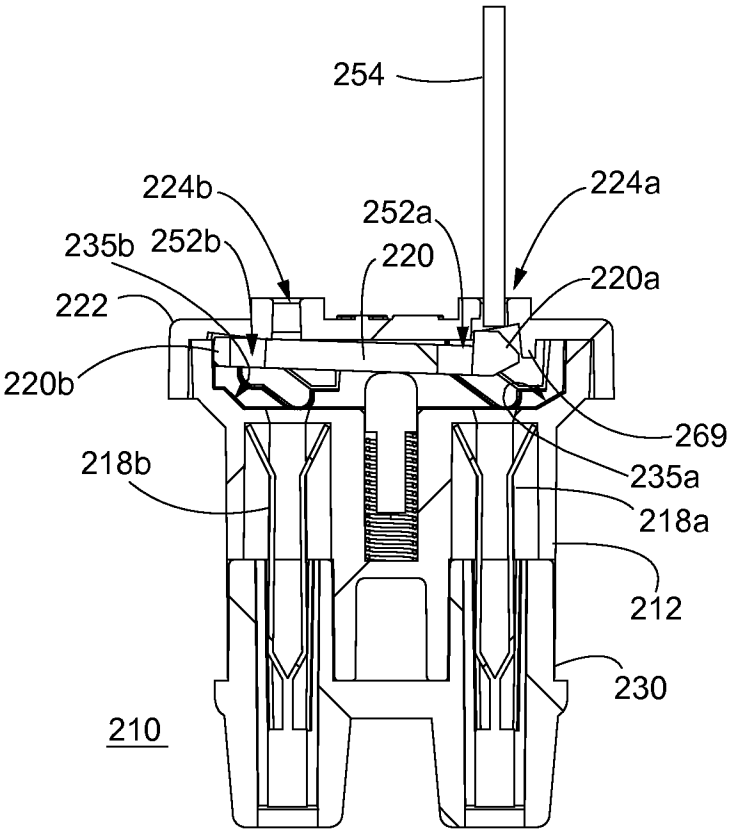
FIG. 18B is another sectional view of the electrical receptacle assembly of FIG. 14, shown with a single nail extending through a second receptacle opening
Figure 18A:
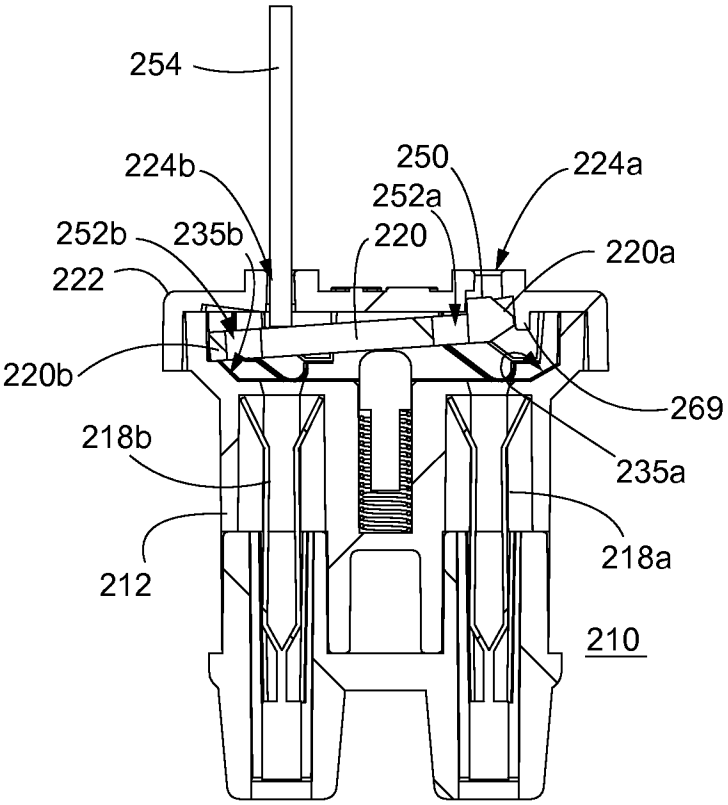
FIG. 18A is a side sectional view of the electrical receptacle assembly of FIG. 14, shown with a single nail extending through a first receptacle opening.

Shutter 220 further includes a raised locking portion 250 in the form of a flat-topped ridge that is directed toward front face portion 222 near first receptacle opening 224*a*, and extends across at least a portion of the width of the shutter. When shutter 220 is in the blocking position of FIGS. 16A and 16B, raised locking portion 250 extends partially into a rear portion of first receptacle opening 224*a*, and remains partially in the rear portion of receptacle opening 224*a* when a foreign object 254 is inserted into only opening 224*a* or 224*b*, such as shown in FIGS. 18A and 18B. However, as shown in FIG. 16C, locking portion 250 disengages receptacle opening 224*a* when shutter 220 is moved to its non-blocking position. A pair of slots or openings 252*a*, 252*b* are formed or established in shutter 220, with first opening 252*a* spaced inboard of locking portion 250. Openings 252*a*, 252*b* align with respective ones of the receptacle openings 224*a*, 224*b* and the hot and the neutral electrical contacts 218*a*, 218*b* when shutter 220 is in its non-blocking position (FIG. 16C), and openings 252*a*, 252*b* misalign with the receptacle openings 224*a*, 224*b* and the hot and neutral electrical contacts 218*a*, 218*b* when shutter 220 is in one of its blocking positions of FIGS. 16A, 16B, 18A, and 18B.

Figure 19A:
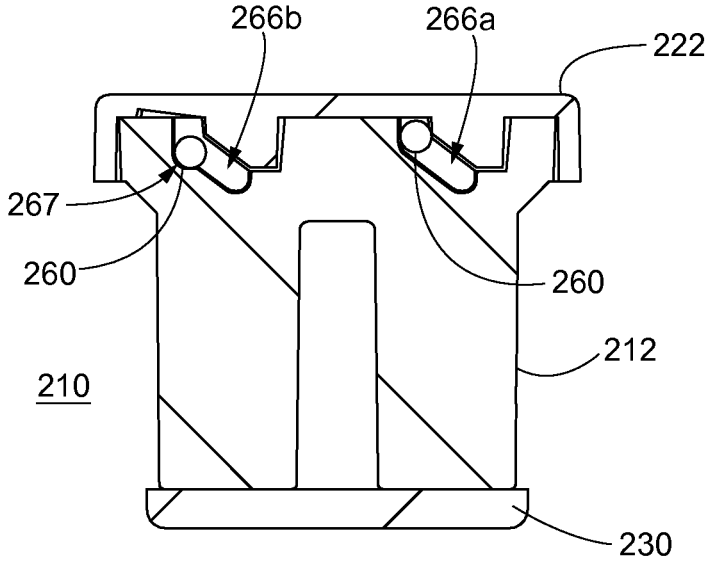
FIG. 19A is another side sectional view corresponding to FIG. 18A, taken along a plane that is spaced outboard of the plane of FIG. 18A.

Referring now to FIGS. 18A and 19A, when a foreign object 254 is inserted into the second receptacle opening 224*b* (corresponding to neutral contact 218*b*), a tip of the foreign object 254 contacts shutter 220 adjacent second shutter opening 252*b*. When pressure is applied to shutter 220 by foreign object 254 adjacent second shutter opening 252*b*, the shutter 220 disengages front face portion 222 near second receptacle opening 224*b*, and shutter 220 pivots generally about locking portion 250 and the shutter's first end portion 220*a* until the projections 260 nearest second shutter opening 252*b* are seated in respective detent regions 267 of diagonal slots 266*a* (FIG. 19A), with locking portion 250 seated against an inner surface of front face portion 222 and the shutter's first end portion 220*a* seated against a downward projection 269 of front face portion 222 (FIG. 18A), at which point shutter 220 is substantially precluded from further movement and second shutter opening 252*b* remains misaligned with second receptacle opening 224*b* and with foreign object 254, thus precluding further inward movement of the foreign object 254 toward neutral electrical contact 218*b* (FIGS. 18A and 19A). If foreign object 254 is subsequently removed, shutter 220 pivots back to the blocking position of FIGS. 16A and 16B under the biasing force of spring 226, which is maintained in compression.

Figure 19B:
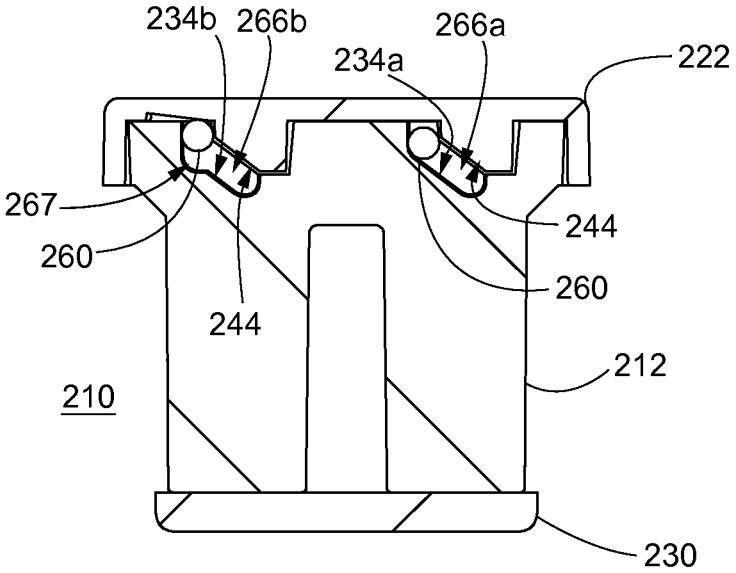
FIG. 19B is another side sectional view corresponding to FIG. 18B, taken along a plane that is spaced outboard of the plane of FIG. 18B.

Similarly, when foreign object 254 is inserted into a first receptacle opening 224*a* (corresponding to hot contact 218*a*), the tip of the foreign object 254 contacts shutter 220 at locking portion 250 (FIG. 18B). As shown in FIGS. 18B and 19B, when pressure is applied to shutter 220 by foreign object 254 at locking portion 250, locking portion 250 partially disengages first receptacle opening 224*a* and shutter 220 pivots generally about the projections nearest second opening 252*b* until the two projections 260 nearest locking portion 250 contact the corresponding lower ramped slide surfaces 234*a* of diagonal slots 266*a*, at which point shutter 220 is substantially precluded from further movement by several locking surfaces including at least (i) the projections 260 nearest second opening 252*b* engaging a surface of front face portion 222 adjacent ramped return surfaces 244, (ii) the projections 260 nearest locking portion 250 engaging the lower ramped slide surfaces 234*a* of diagonal slot 266*b*, and (iii) the shutter's first end portion 220*a* contacting downward projection 269 (FIGS. 18B and 19B). In this condition, first shutter opening 252*a* remains misaligned with first receptacle opening 224*a* and foreign object 254, which precludes further inward movement of the foreign object toward hot electrical contact 218*a*. If foreign object 254 is subsequently removed from first receptacle opening 224*a*, shutter 220 pivots back to the blocking position of FIGS. 16A and 16B.

Referring now to FIGS. 16A-17C, when two prongs 256*a*, 256*b* of an electrical plug 256 are simultaneously inserted into first and second receptacle openings 224*a*, 224*b*, tips of prongs 256*a*, 256*b* contact shutter 220, with first prong 256*a* contacting locking portion 250 just before second prong 256*b* contacts shutter 220 near second opening 252*b* if the prongs are evenly aligned with one another when inserted. When pressure is applied to shutter 220 by prongs 256*a*, 256*b* simultaneously, shutter 220 moves rearwardly (i.e., downwardly toward base surface 238 as viewed in the figures) so that the shutter's projections 260 nearest locking portion 250 contact ramped slide surfaces 234*a* with the shutter's projections 260 nearest second shutter opening 252*b* being spaced above detent region 267, such as shown in FIG. 17B. Shutter 220 is then biased laterally via sliding engagement initially by projections 260 nearest locking portion 250 along ramped slide surfaces 234*a*, and then by all four of the shutter's projections 260 sliding along the corresponding ramped slide surfaces 234*a*, 234*b* of diagonal slots 266*a*, 266*b*, and by sliding engagement of the shutter's second end portion 220*b* along second ramped base surface 235*b*. This movement of shutter 220 continues until openings 252*a*, 252*b* align with prongs 256*a*, 256*b*, thus allowing the prongs to slide through openings 252*a*, 252*b* and engage the respective electrical contacts 218*a*, 218*b* upon the application of sufficient force to overcome friction and the biasing force of spring 226 (FIG. 16C). Upon subsequent removal of prongs 256*a*, 256*b*, shutter 220 returns to the blocking position of FIG. 16A under the biasing force of spring 226, and due to sliding engagement of all four projections 260 with ramped return surfaces 244 of diagonal slots 266*a*, 266*b*.

Figure 20:
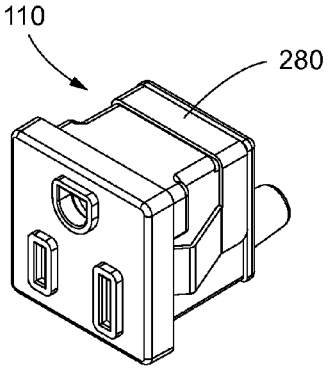
FIG. 20 is a front perspective view of another access-restricted electrical receptacle in accordance with the present invention, shown fitted with a spring-clip mount.
Figure 21:
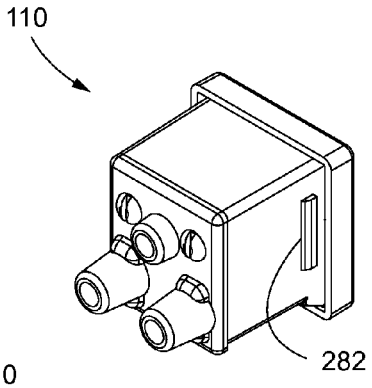
FIG. 21 is a rear perspective view of another access-restricted electrical receptacle in accordance with the present invention, including a molded snap-fit element.
Figure 22:
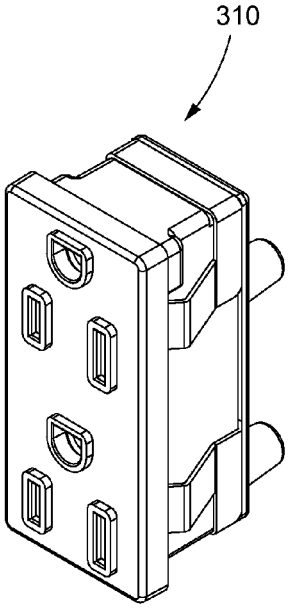
FIG. 22 is a front perspective view of a duplex-style access-restricted electrical receptacle in accordance with the present invention.
Figure 23:
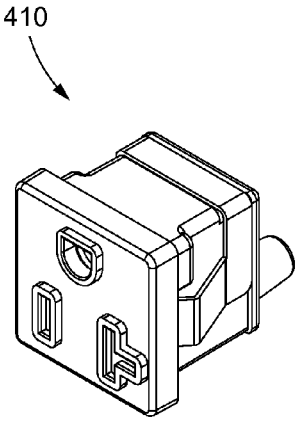
FIG. 23 is a front perspective view of a 20-amp access-restricted electrical receptacle in accordance with the present invention.
Figure 24:
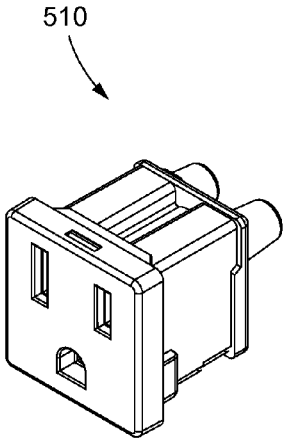
FIG. 24 is a front perspective view of another access-restricted electrical receptacle in accordance with the present invention.

It will be appreciated that the principles of the present invention may be incorporated into different styles of electrical outlets, including duplex (two plug) outlets 310 (FIG. 22) and outlets having different receptacle opening configurations such as a 20-amp configuration 410 of FIG. 23, in addition to the simplex (single plug) outlets 10, 110, 210 that are described above. It is further envisioned that the access-restricting mechanisms described herein may be incorporated in to multiple-receptacle power strips or the like. Simplex, duplex, or similar receptacles incorporating the access-restricting mechanisms may also be configured for releasable mounting in square or rectangular openings using spring clips 280 (FIGS. 20, 22, and 23) or raised ridges 282 (FIG. 21) along the receptacle bodies to engage a panel or the like. Standard 110V configuration outlets 510 (FIG. 24) may also incorporate the access-restricting mechanisms.

Accordingly, access-restricted electrical receptacle of the present invention provides improved safety by substantially limiting access to its electrical contacts to compatible plugs that are properly inserted. A foreign object inserted into one of the openings in a front face of the receptacle will cause a movable shutter to lock in a blocking position, thereby preventing access to at least two (e.g., hot and neutral) electrical contacts that would present a danger. The shutter is guided between blocking and non-blocking positions by ramped surfaces when a plug is properly inserted, but locking surfaces (and in some cases also the ramped surfaces) preclude movement of the shutter to a non-blocking position in response to an attempt at improper insertion of an object.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. An access-restricted electrical receptacle comprising:

a receptacle body defining a shutter cavity and a ramped slide surface;

a plurality of electrical contacts disposed in said receptacle body and accessible via said shutter cavity, said electrical contacts configured to receive respective prongs of an electrical plug associated with an electrical consumer;

a face portion coupled to said receptacle body and substantially covering said shutter cavity, said face portion defining a plurality of receptacle openings that are generally aligned with corresponding ones of said electrical contacts, and said face portion defining a ramped return surface spaced from said ramped slide surface;

a shutter movably disposed in said shutter cavity of said receptacle body, said shutter having a first contact surface configured to engage said ramped slide surface, and a second contact surface configured to engage said ramped return surface, wherein said shutter is movable between (i) at least one blocking position in which said shutter substantially precludes access to said electrical contacts through said receptacle openings, and (ii) a non-blocking position in which said shutter permits access to said electrical contacts through said receptacle openings;

first and second locking surfaces defined by one or both of said receptacle body and said face portion, said first and second locking surfaces defining respective portions of said shutter cavity; and a biasing member disposed at least partially in said shutter cavity and configured to bias said shutter in a direction toward said face portion;

wherein said shutter is configured to (i) move from said at least one blocking position to said non-blocking position via sliding engagement of said first contact surface along said ramped slide surface, (ii) move from said non-blocking position to said at least one blocking position via sliding engagement of said second contact surface along said ramped return surface, and (iii) be positioned in said at least one blocking position in response to an object being inserted into only one of said receptacle openings and causing a portion of said shutter to engage at least one of said first and second locking surfaces.

2. The electrical receptacle of claim 1, wherein said receptacle body defines at least two of said ramped slide surfaces at said shutter cavity and said face portion defines at least two of said ramped return surfaces spaced from respective ones of said ramped slide surfaces.

3. The electrical receptacle of claim 2, wherein said receptacle body comprises a plurality of sidewalls substantially surrounding said shutter cavity, and wherein said sidewalls define said ramped slide surfaces.

4. The electrical receptacle of claim 3, wherein said ramped return surfaces project rearwardly from a rear surface said face portion, thereby defining sloped slots between corresponding ones of said ramped return surfaces and said ramped slide surfaces, and wherein said shutter comprises wing projections extending laterally outwardly from opposite sides thereof and into respective ones of said sloped slots, each of said wing projections comprising one of said first contact surfaces and one of said second contact surfaces.

5. The electrical receptacle of claim 4, wherein said receptacle body comprises a ramped base surface at said shutter cavity, and said shutter comprises an end contact surface at one end thereof, said end contact surface configured to engage said ramped base surface upon movement of said shutter to said non-blocking position and also in at least one of said blocking positions.

6. The electrical receptacle of claim 4, wherein said first locking surface comprises a detent region formed in one of said sloped slots and said second locking surface comprises a projection of said face portion that extends into said shutter cavity.

7. An access-restricted electrical receptacle comprising:

a receptacle body defining a shutter cavity;

a plurality of electrical contacts disposed in said receptacle body and accessible via said shutter cavity, said electrical contacts configured to receive respective prongs of an electrical plug associated with an electrical consumer;

at least one ramped slide surface at or adjacent said shutter cavity;

a face portion coupled to said receptacle body and substantially covering said shutter cavity, said face portion defining a plurality of receptacle openings that are generally aligned with corresponding ones of said electrical contacts; and at least one ramped return surface located at or adjacent said shutter cavity and spaced from said at least one ramped slide surface;

a shutter movably disposed in said shutter cavity of said receptacle body, said shutter having a first contact surface configured to engage said ramped slide surface, and a second contact surface configured to engage said ramped return surface, wherein said shutter is movable between (i) at least one blocking position in which said shutter substantially precludes access to said electrical contacts through said receptacle openings, and (ii) a non-blocking position in which said shutter permits access to said electrical contacts through said receptacle openings;

first and second locking surfaces defined by one or both of said receptacle body and said face portion, said first and second locking surfaces defining respective portions of said shutter cavity; and a biasing member disposed at least partially in said shutter cavity and configured to bias said shutter in a direction toward said face portion;

wherein said shutter is configured to:

move from said non-blocking position to said at least one blocking position in response to removal of the prongs of the electrical plug from said receptacle openings, thereby causing said second contact surface to engage said ramped return surface in a lateral sliding manner;

move from said at least one blocking position to said non-blocking position in response to the prongs of the electrical plug being inserted substantially simultaneously through said receptacle openings, thereby causing said first contact surface to engage said ramped slide surface in a lateral sliding manner; and remain in said at least one blocking position in response to an object being inserted into only one of said receptacle openings and causing a portion of said shutter to engage one of said first and second locking surfaces to substantially prevent lateral sliding movement of said shutter.

8. The electrical receptacle of claim 7, wherein said at least one ramped slide surface is defined by a base portion of said receptacle body that defines a rear surface of said shutter cavity.

9. The electrical receptacle of claim 8, wherein said shutter comprises a pair of opposite end portions, and wherein at least one of said end portions defines said first and second contact surfaces of said shutter.

10. The electrical receptacle of claim 7, wherein said at least one ramped slide surface is defined by a sidewall of said receptacle body that defines a side portion of said shutter cavity.

11. The electrical receptacle of claim 10, wherein said shutter comprises a pair of opposite side portions and at least one wing projection extending laterally outwardly from each of said side portions, and wherein each of said wing projections defines one of said first contact surfaces and one of said second contact surfaces of said shutter.

12. The electrical receptacle of claim 7, wherein said first and second contact surfaces of said shutter comprise angled surfaces that generally conform to respective angles of said ramped slide surface and said ramped return surface, respectively.

13. The electrical receptacle claim 7, wherein said at least one ramped slide surface comprises at least two surfaces that are substantially parallel to one another.

14. The electrical receptacle of claim 7, wherein said at least one ramped return surface is defined by said face portion.

15. The electrical receptacle of claim 7, wherein said first and second locking surfaces are formed in a rearward surface of said face portion.

16. The electrical receptacle of claim 15, wherein said shutter comprises respective projections that are selectively received in said notches when said shutter is in said at least one blocking position.

17. The electrical receptacle of claim 7, wherein said shutter defines a pair of shutter openings configured to align with said receptacle openings and said electrical contacts upon movement of said shutter to said non-blocking position.

18. The electrical receptacle of claim 7, wherein said shutter defines at least one ridge configured to extend at least partially into one of said receptacle openings upon movement of said shutter to said non-blocking position.

19. The electrical receptacle of claim 7, wherein said biasing member comprises a coil spring.

20. The electrical receptacle of claim 7, wherein said face portion is configured to engage said receptacle base via a snap-fit arrangement.

* * * * *